US009032582B2

(12) United States Patent
Sgroi, Jr. et al.

(10) Patent No.: US 9,032,582 B2
(45) Date of Patent: May 19, 2015

(54) CLEANING IMPLEMENTS

(75) Inventors: Anthony Sgroi, Jr., Wallingford, CT (US); David Quinlan, Plantsville, CT (US); Jeffrey T. Mulreed, Shelton, CT (US); Paul H. Adams, Monroe, CT (US)

(73) Assignee: Unger Marketing International, LLC, Brideport, CT (US)

( * ) Notice: Subject to any disclaimer, the term of this patent is extended or adjusted under 35 U.S.C. 154(b) by 906 days.

(21) Appl. No.: 12/460,187

(22) Filed: Jul. 15, 2009

(65) Prior Publication Data

US 2010/0017992 A1 Jan. 28, 2010

Related U.S. Application Data

(60) Provisional application No. 61/134,927, filed on Jul. 15, 2008.

(51) Int. Cl.

| | |
|---|---|
| ***A47L 13/16*** | (2006.01) |
| ***A47L 13/25*** | (2006.01) |
| ***A47L 13/18*** | (2006.01) |
| ***A47L 13/38*** | (2006.01) |

(52) U.S. Cl.

CPC ..... *A47L 13/25* (2013.01); *A47L 13/16* (2013.01); *A47L 13/18* (2013.01); *A47L 13/38* (2013.01)

(58) Field of Classification Search

CPC ..... A47L 13/16; A47L 13/38; A47L 13/46; A47L 25/00; A47L 13/252; A47L 13/18

USPC ..... 15/209.1, 210.1, 228.9

See application file for complete search history.

(56) References Cited

U.S. PATENT DOCUMENTS

| | | | | | |
|---|---|---|---|---|---|
| 1,185,564 | A | | 5/1916 | Williams | 15/120.2 |
| 1,793,782 | A | | 2/1931 | Dietrich | 15/147.2 |
| 1,795,651 | A | | 3/1931 | Hunter | 15/229.9 |
| 3,381,334 | A | * | 5/1968 | Redmond | 15/229.3 |
| D274,854 | S | | 7/1984 | Nishiyama | D32/50 |
| D274,855 | S | | 7/1984 | Nishiyama | D32/50 |
| D296,022 | S | | 5/1988 | Restivo | D32/51 |
| 4,827,556 | A | | 5/1989 | Corsetti | 15/244.1 |
| 4,841,592 | A | | 6/1989 | Restivo | 15/210.1 |
| 4,852,210 | A | * | 8/1989 | Krajicek | 15/228 |
| D304,106 | S | | 10/1989 | Dobson et al. | D32/40 |
| 5,116,151 | A | | 5/1992 | Lytton | 401/9 |
| D328,373 | S | | 7/1992 | Murray | D32/40 |
| 5,319,821 | A | | 6/1994 | Nicholson | 15/104.8 |
| D350,424 | S | | 9/1994 | Elliott | D32/40 |

(Continued)

OTHER PUBLICATIONS

Casabella Clean, Microfiber Ceiling Fan Duster, www.casabella.com.

*Primary Examiner* — Laura C Guidotti

(74) *Attorney, Agent, or Firm* — Ohlandt, Greeley, Ruggiero & Perle, LLP

(57) ABSTRACT

A cleaning implement for cleaning a ceiling fan blade is provided. The cleaning implement includes a frame, a single cleaning cloth, and gripping portion. The frame has an open end and a closed end opposite the open end so that the frame defines a fan blade receiving opening. The opening receives the ceiling fan blade therein when the ceiling fan blade has a width that is smaller than, equal to, or larger than a width of the first fan blade receiving opening. The single cleaning cloth is removably disposed on the frame so that a cleaning surface of the single cleaning cloth can contact at least one surfaces of the ceiling fan blade. The gripping portion is connected to the frame.

20 Claims, 22 Drawing Sheets

(56) References Cited

U.S. PATENT DOCUMENTS

| | | | | |
|---|---|---|---|---|
| 5,609,255 | A * | 3/1997 | Nichols | 206/576 |
| D425,679 | S | 5/2000 | Long | D32/40 |
| 6,503,615 | B1 | 1/2003 | Horii et al. | 428/316.6 |
| 7,363,674 | B2 | 4/2008 | Marshall | 15/104.94 |
| 7,478,453 | B1 * | 1/2009 | Busshaus | 15/228 |
| 7,784,141 | B2 * | 8/2010 | Knopow et al. | 15/210.1 |
| 2006/0231120 | A1 * | 10/2006 | Knopow | 134/6 |
| 2009/0106924 | A1 * | 4/2009 | Park | 15/190 |

* cited by examiner

CLEANING IMPLEMENTS

CROSS REFERENCE TO RELATED APPLICATIONS

This application claims the benefit of U.S. Provisional Application Ser. No. 61/134,927, filed Jul. 15, 2008, the contents of which are incorporated by reference herein.

BACKGROUND OF THE INVENTION

1. Field of the Invention

The present disclosure is related to cleaning implements. More particularly, the present disclosure is related to cleaning implements for removing dust from surfaces, and more specifically to cleaning implements configured to remove dust from ceiling fan blades of varying widths.

2. Description of Related Art

Ceiling fans are used in a variety of residential and commercial applications to circulate air within a building. It is known that dust can settle on the upper face of the fan blade. In order to remove dust accumulated on the fan for reasons of aesthetics and/or to prevent the spreading of the accumulated dust when using the fan, it is often desired for the dust to be cleaned from the fan blades.

The cleaning of fan blades is often made difficult due to the shape of the fan blades, the difficulty in gaining access to such blades, and the height of the fan with respect to the ground. Further, the cleaning of fan blades is often made difficult by the fact that the blades tend to rotate freely when the cleaning process applies forces perpendicular to the fan's axis of rotation.

Many fan blade cleaning implements include a structure with a cleaning cloth or brush having a closed passage. The closed passage is slid over the fan blade so that the cleaning cloth or brush wipes dust from the blade. Unfortunately, the closed passage only works with fan blades having a width equal to or less than the width of the closed passage.

Therefore, there is a need for fan blade cleaning implements that overcome, alleviate, and/or mitigate one or more of the aforementioned and other deleterious effects of prior art cleaning implements.

BRIEF SUMMARY OF THE INVENTION

Cleaning implements are provided that are configured to remove dust from a variety of surfaces.

Moreover, fan blade cleaning implements are provided, which are adapted for use with fan blades of varying widths, and in some embodiments fan blades of varying heights.

In some embodiments, the fan blade cleaning implement has a fan blade receiving opening with one closed end and one open end is provided. Preferably, the fan blade cleaning implement requires only one cleaning cloth.

In other embodiments, the fan blade cleaning implement has two frames, each with a fan blade receiving opening and each with a closed end. The frames are connected to a handle so that the closed ends are oppositely disposed with respect to one another. Further, the frames are connected to the handle so that the two frames are adjustable with respect to one another to adjust the width of the opening between the two closed ends.

A cleaning implement for cleaning a ceiling fan blade is provided. The cleaning implement includes a frame, a single cleaning cloth, and gripping portion. The frame has an open end and a closed end opposite the open end so that the frame defines a fan blade receiving opening. The opening receives the ceiling fan blade therein when the ceiling fan blade has a width that is smaller than, equal to, or larger than a width of the first fan blade receiving opening. The single cleaning cloth is removably disposed on the frame so that a cleaning surface of the single cleaning cloth can contact at least one surface of the ceiling fan blade. The gripping portion is connected to the frame.

A cleaning implement for cleaning a ceiling fan blade is provided. The cleaning implement includes a frame, a single cleaning cloth, and gripping portion. The frame is formed of a single bent length of metal wire having two ends connected to the gripping portion. The frame has an open end and a closed end opposite the open end so that the frame defines a fan blade receiving opening that receives the ceiling fan blade therein when the ceiling fan blade has a width that is smaller than, equal to, or larger than a width of the first fan blade receiving opening. The cleaning cloth is removably disposed on the frame so that a cleaning surface of the single cleaning cloth can contact at least one surface of the ceiling fan blade.

A cleaning implement for cleaning a ceiling fan blade is also provided, which includes a first frame, a second frame, and a gripping portion. The first and second frames each have an open end and a closed end opposite the open end so that the frame defines a fan blade receiving opening for receiving the ceiling fan blade therein. The frames are connected to the gripping portion so that the closed ends are oppositely disposed with respect to one another and the open ends are oppositely disposed with respect to one another. In addition, the frames are connected to the gripping portion so that the frames are moveable with respect to one another so as to increase or decrease a width between the closed ends.

The above-described and other features and advantages of the present disclosure will be appreciated and understood by those skilled in the art from the following detailed description, and drawings.

DETAILED DESCRIPTION OF THE INVENTION

Figure 1:
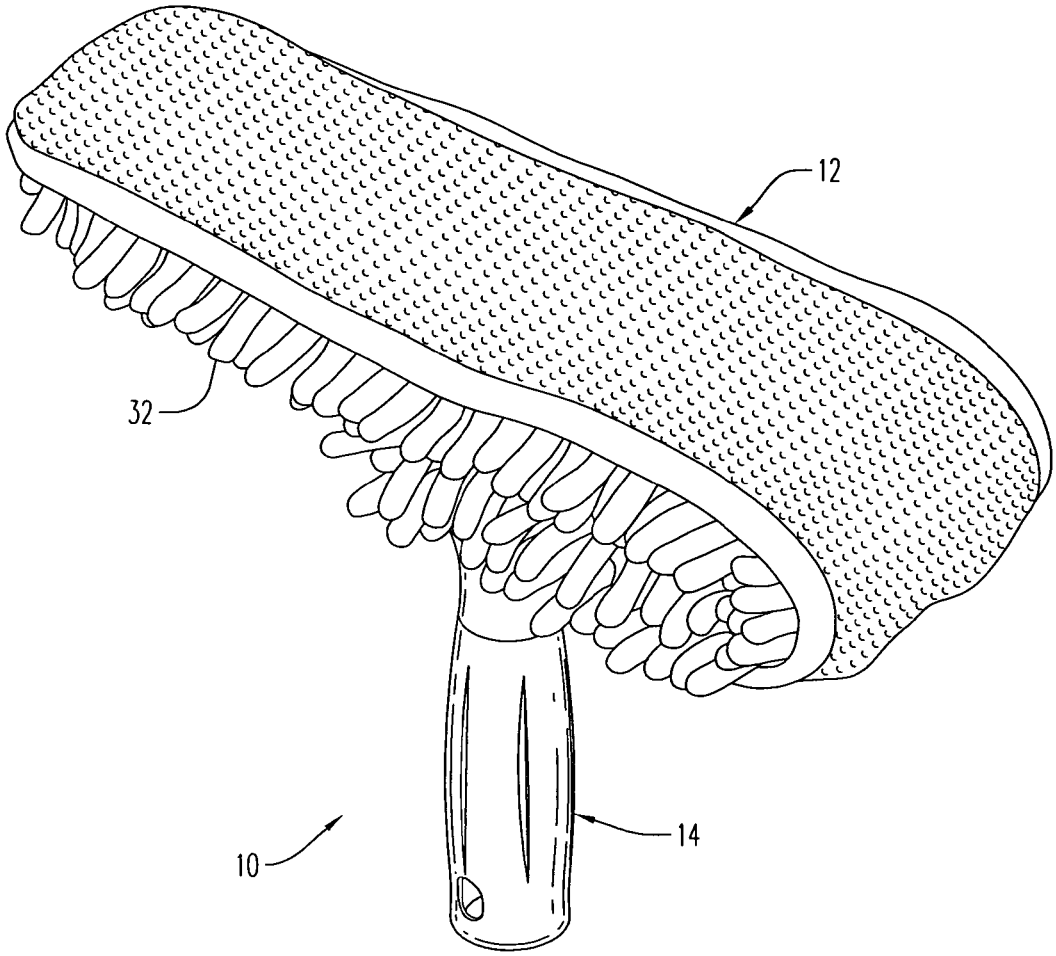
FIG. 1 is a perspective view of a first exemplary embodiment of a cleaning implement according to the present disclosure.

Referring to the drawings and in particular to FIGS. 1 through 4, a cleaning implement according to exemplary embodiments of the present disclosure is shown having reference numeral 10. Cleaning implement 10 includes a cleaning cloth 12 and a handle 14.

Advantageously, cleaning implement 10 includes a fan blade receiving opening 16 that allows the cleaning implement to work with a fan blade F (FIG. 4) of any width. More particularly, cleaning implement 10 can be placed over the fan blade F so that the blade is received in opening 16 with a cleaning surface 18 contacting an upper surface of the blade. In this position, cleaning implement 10 can be passed along the length of the fan blade to allow cleaning surface 18 to remove dust from the upper surface of the blade.

In the event that the fan blade has a width ($W_F$) that is larger than a width of opening 16, a cleaning operation using implement 10 can be completed in two passes. Here, the cleaning implement 10 can be placed over the fan blade so that a closed end 20 of the cleaning implement is adjacent one side of the blade and the cleaning implement 10 can be passed along the length of the fan blade. Then, cleaning implement 10 can be reversed so that the closed end 20 is adjacent the opposite side of the blade and the cleaning implement 10 can again be passed along the length of the fan blade.

Accordingly, cleaning implement 10 includes a fan blade receiving opening 16 that includes closed end 20 and an open end 22. Thus, cleaning implement 10 can find use with fan blades (F) having widths ($W_F$) that are smaller than, equal to, or larger than the width of opening 16. Further, cleaning implement 10 allows for the cleaning of multiple sides of the fan blade (F) with only one cleaning cloth.

It should be noted that cleaning implement 10 is described herein by way of example only in use with fan blades (F). However, it is contemplated by the present disclosure for cleaning implement 10 (as well as all of the embodiments of the cleaning implement described herein below) to find use with any object such as, but not limited to hanging lamps, drapery rods, furniture legs, and others.

Figure 2A:
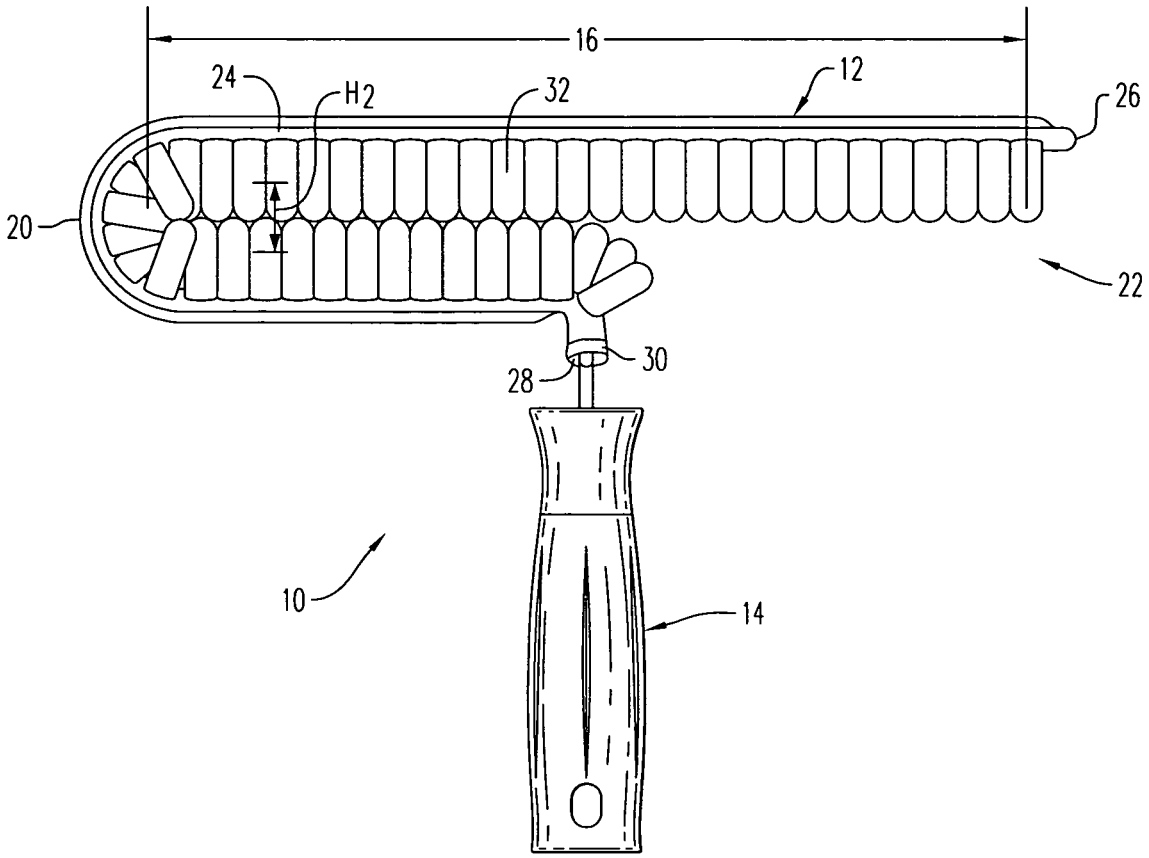
FIG. 2A is a side view of the cleaning implement of FIG. 1.
Figure 2B:
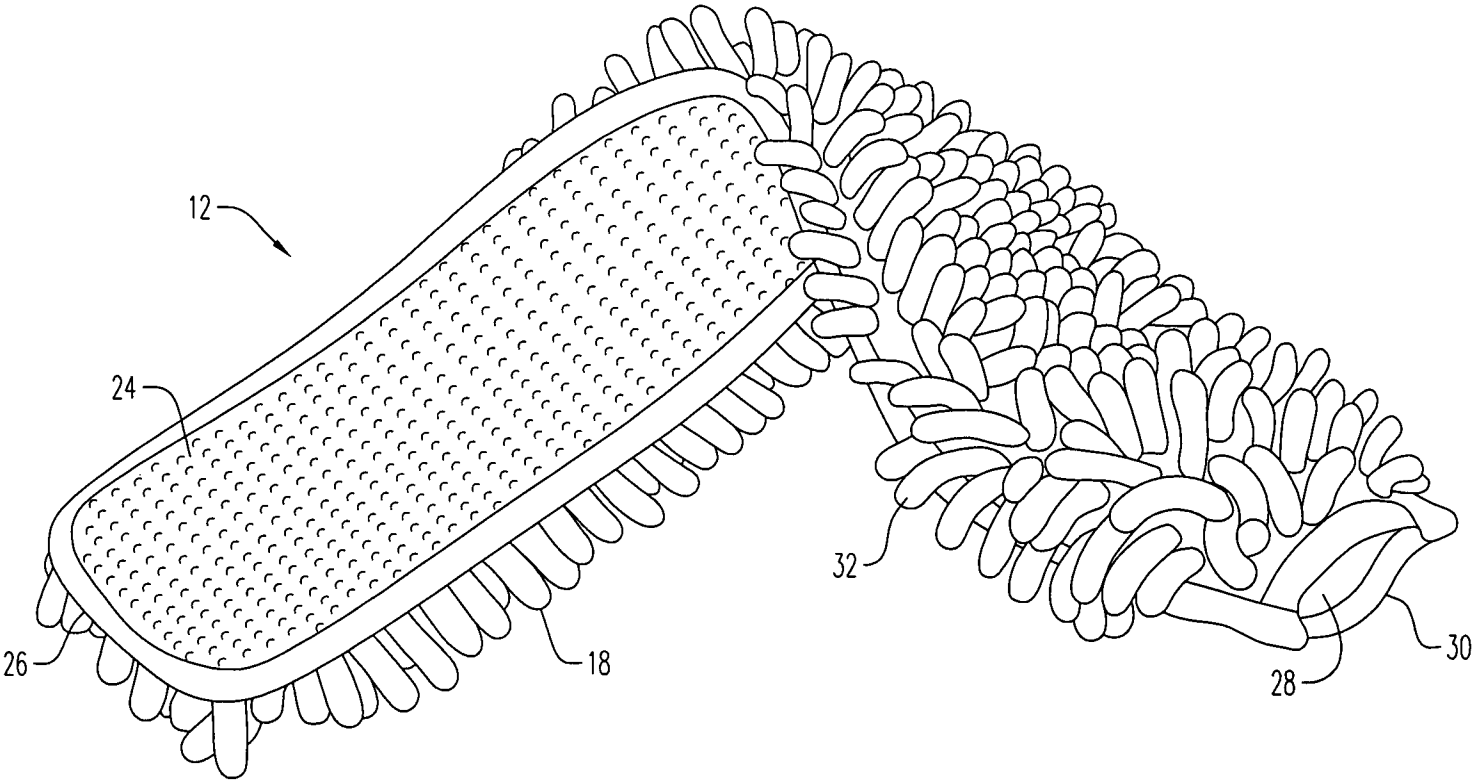
FIG. 2B is a perspective view of an exemplary embodiment of a cleaning cloth for use on the cleaning implement of FIG. 1, shown in a partially folded state.

As seen in FIG. 2B, cleaning cloth 12 has a generally tubular body 24 with a first end 26 and a second end 28. In some embodiments, second end 28 can be an open end that includes an elastic closure 30 for assisting in maintaining the cleaning cloth on handle 14 when in use. In other embodiments, first end 26 can also be an open end that includes the elastic closure.

Figure 3:
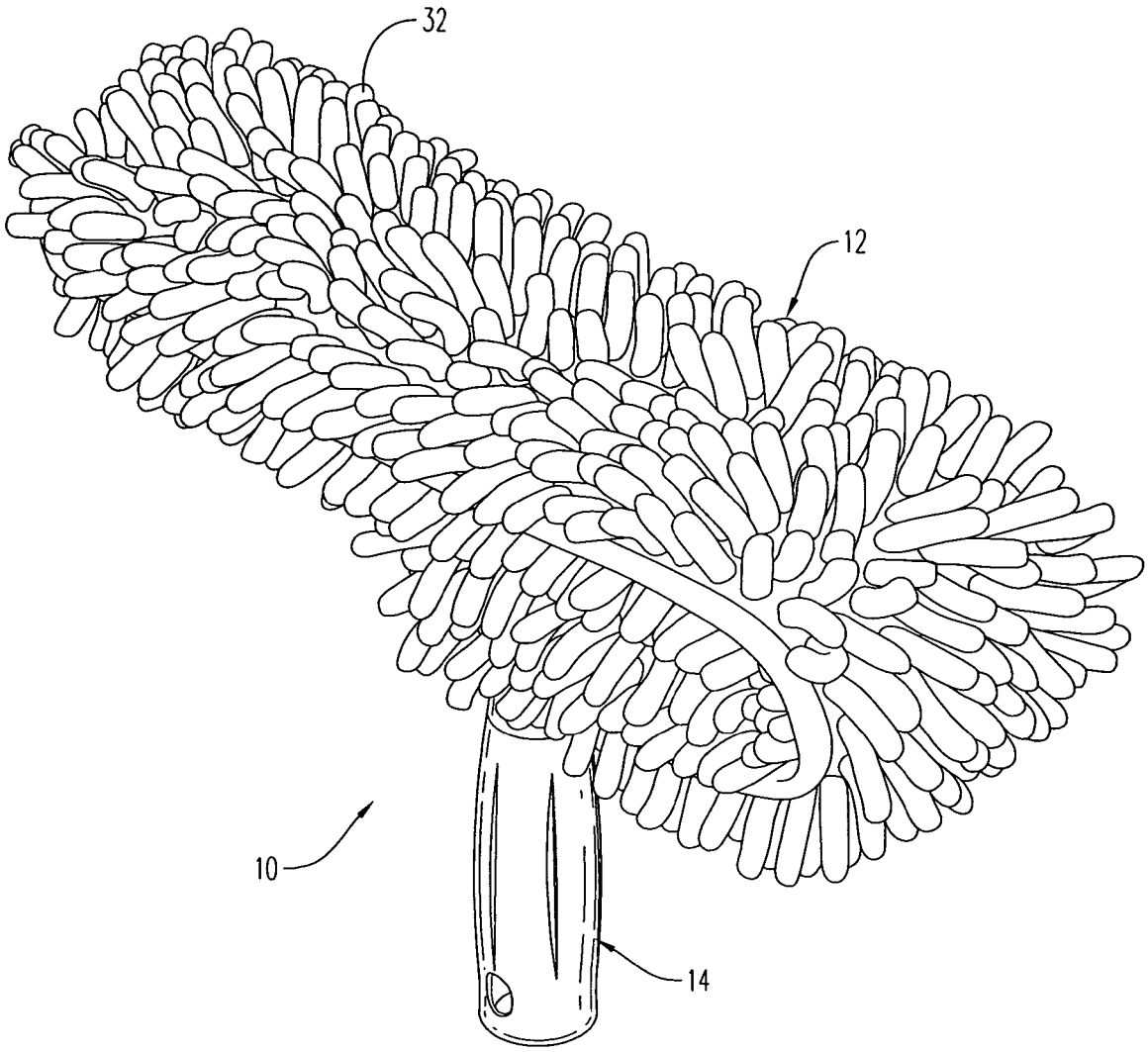
FIG. 3 is a perspective view of an alternate exemplary embodiment of the cleaning implement of FIG. 1.
Figure 4:
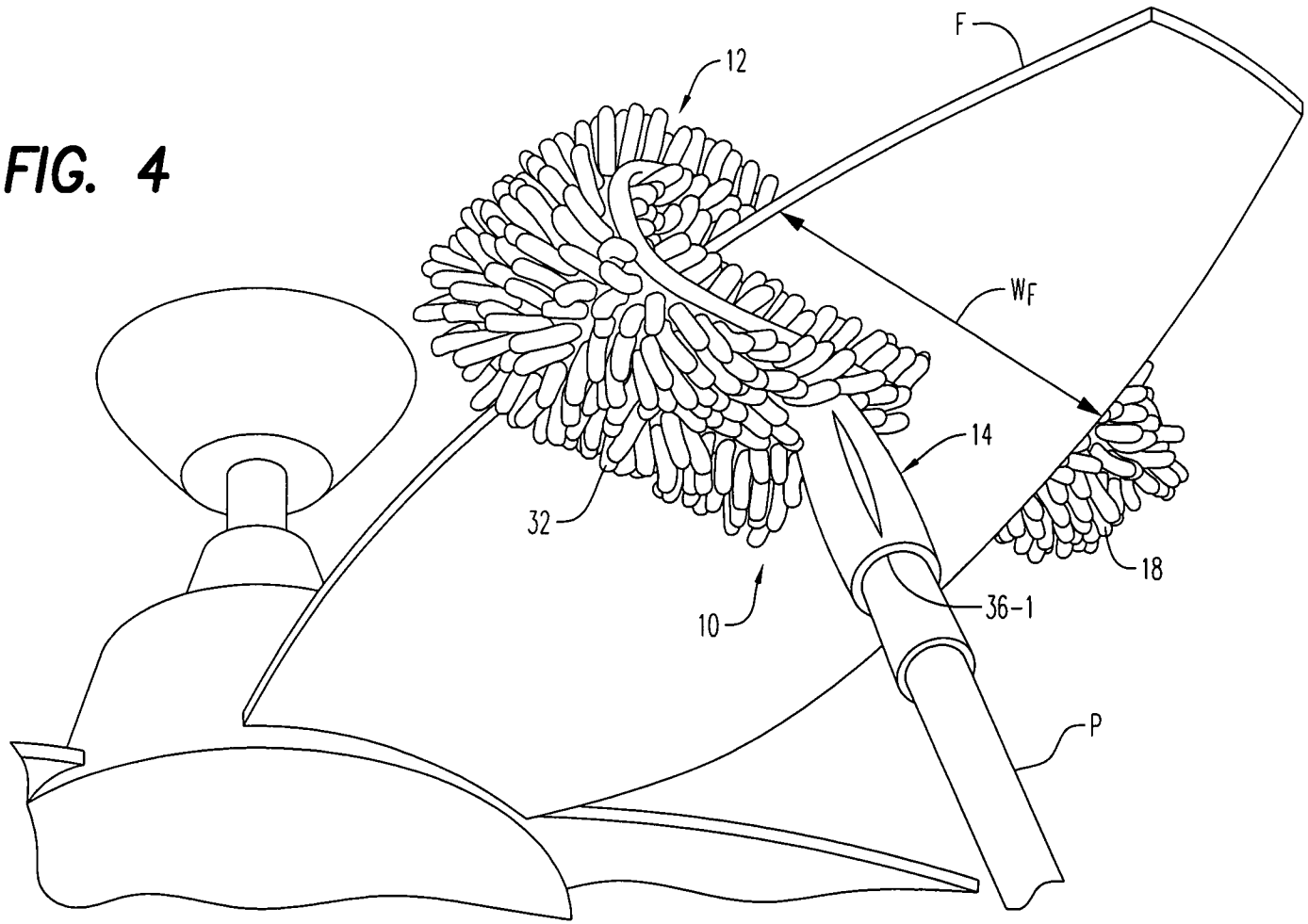
FIG. 4 illustrates the cleaning implement of FIG. 3 in use with a ceiling fan.

In the illustrated embodiment of FIGS. 1 and 2, cleaning cloth 12 is a microfiber cleaning cloth having a twisted loop pile 32 on only one side. However, cleaning cloth 12 is illustrated in FIGS. 3 and 4 as a microfiber cleaning cloth having twisted loop pile 32 on two sides. Further, it is contemplated by the present disclosure for cleaning cloth 12 to be reversible, such that the cleaning cloth can be inverted or turned inside out so that all surfaces of the cleaning cloth are useable for dusting. Of course, it is contemplated by the present disclosure for cleaning cloth 12 to be made of any material suitable for dusting and/or cleaning a ceiling fan including use with water or other cleaners.

Advantageously, cleaning cloth 12 can be repositioned on handle 14 so that any surface of the cleaning cloth can function as the cleaning surface 18. For example, the cleaning cloth 12 can be rotated about handle 14 so that clean portions of the cleaning cloth can be presented as the cleaning surface. In this manner, cleaning cloth 12 can be repositioned on handle 14 to provide an unused cleaning surface 18 instead requiring cleaning of the cloth. Further, cleaning cloth 12 can have cleaning surfaces configured for different cleaning purposed. For example, one side of cleaning cloth 12 can include the aforementioned twisted loop pile 32, while an opposite side can include a different type of cleaning surface such as, but not limited to, an abrasive surface, a wettable surface, a natural fiber surface, a cotton surface, a microfiber surface, materials having electrostatic properties, and any combinations thereof. It is also contemplated by the present disclosure for cleaning cloth 12 to be made from any desired manufacturing process such as, but not limited to, as knitting, weaving, non-woven methods, and others.

Figure 5:
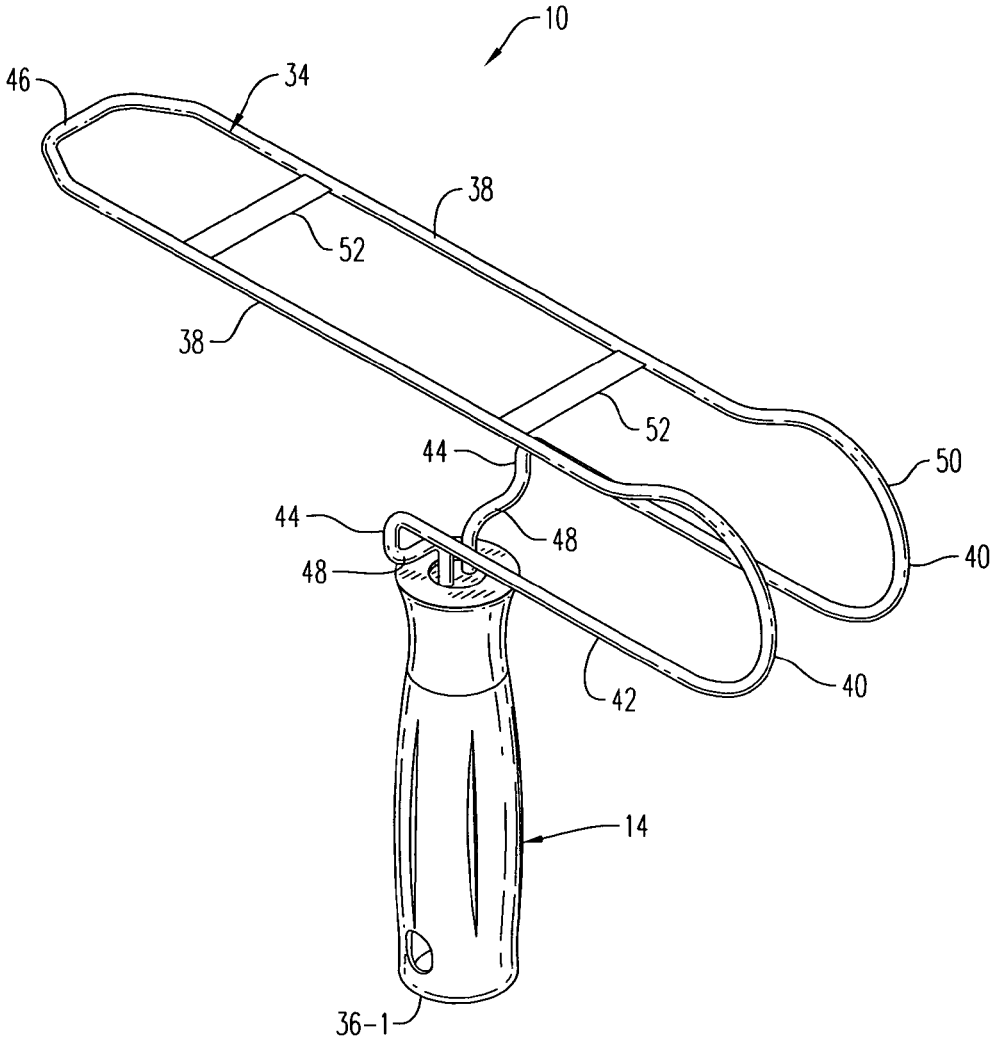
FIG. 5 is a perspective view of a handle for use with the cleaning implement of FIG. 1 or 2.
Figure 6:
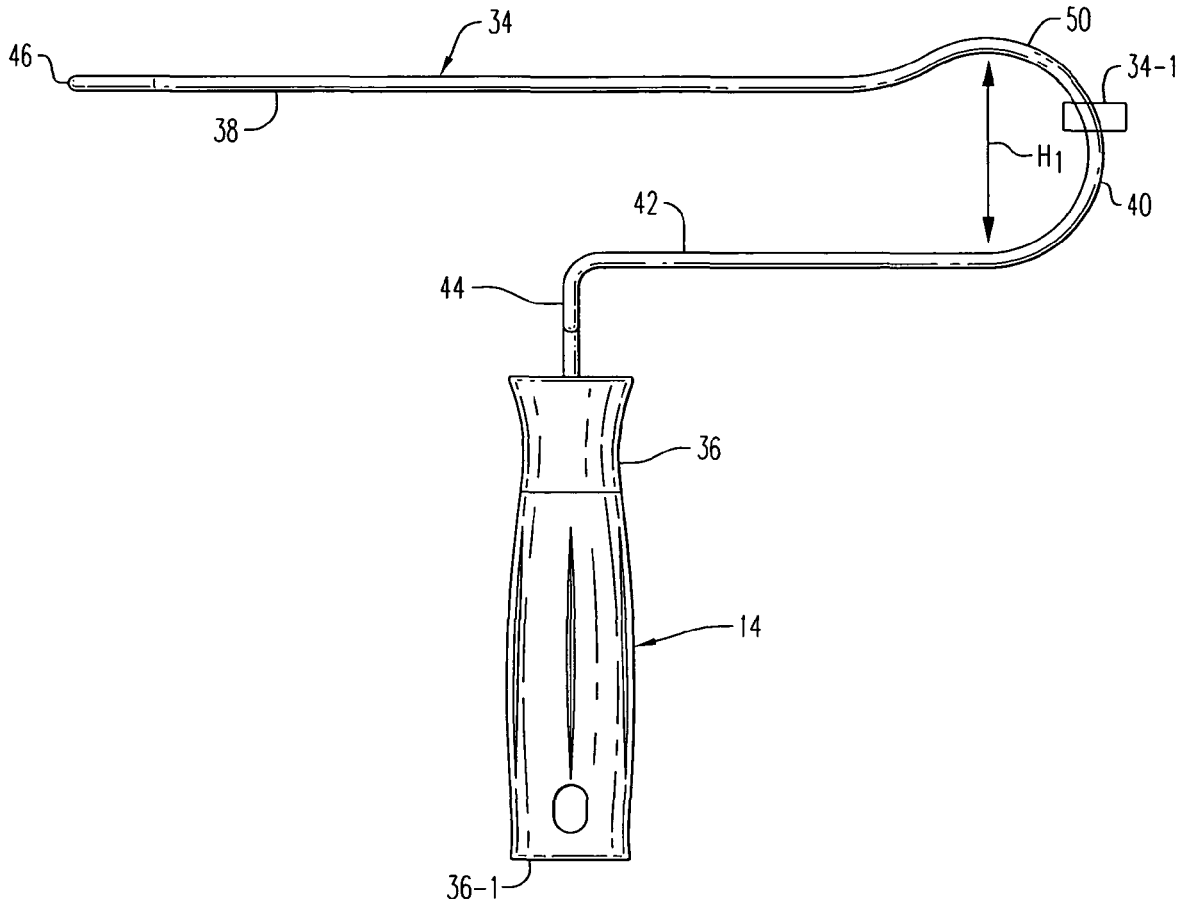
FIG. 6 is a side view of the handle of FIG. 5, the opposite side being identical thereto.

Handle 14 is described in detail with respect to FIGS. 5 and 6. Handle 14 includes a frame 34 and a gripping portion 36. Gripping portion 36 can include an opening 36-1 for connection with a pole P (FIG. 4). For example, opening 36-1 can be an internally threaded opening, a tapered press fit opening, or any other connection device. Handle 14 can be made of any desired material such as, but not limited to, metal, plastic, wood, elastomeric, rubber, thermoplastic elastomer (TPE), and any combinations thereof. In one embodiment, handle 14 is made of a molded plastic.

Gripping portion 36 and frame 34 can be secured to one another in a rigid manner such that the gripping portion and frame are locked into a single position with respect to one another. Alternately, gripping portion 36 and frame 34 can be secured to one another such that the gripping portion and frame can be selectively moved and, some embodiments, fixed into a variety of angled positions with respect to one another as discussed in detail below with respect to the embodiment of FIGS. 15-18.

Frame 34 defines a first transverse leg 38, a first upright leg 40, a second transverse leg 42, and a second upright leg 44. First upright leg 40 has a first height (H1) (FIG. 6) that is sufficient to separate first and second transverse legs 38, 42 from one another to define opening 16 of the cleaning implement 10 with a second height (H2) (FIG. 2A) and to define closed end 20 of the cleaning implement. Further, first transverse leg 38 terminates at a terminating end 46, which is above opening 16 to define open end 22.

In some embodiments, first upright leg 40 can have first height (H1) that is fixed based on the design and stiffness of the material of frame 34. In other embodiments, frame 34 can have sufficient flexibility to allow first upright leg 40 to have first height (H1) that can be adjusted. In still other embodiments, frame 34 can include a height adjusting device 34-1 (FIG. 6) at first upright leg 40 that allows a user to selectively adjust the first height (H1).

It has been determined by the present disclosure that the stiffness or flexibility of frame 34 in combination with the first height (H1) of first upright leg 40 is important to the amount of pressure that is applied to the object being cleaned. It has also been determined by the present disclosure that the second height (H2) is important to the amount of pressure that is applied to the object being cleaned. Thus, the type of cleaning cloth 12 being used effects the second height (H2) for any given first height (H1). For example, cleaning cloth 12 having twisted loop pile 32 has a smaller second height (H2) as compared to use of cleaning cloth lacking the twisted loop pile assuming that frame 34 has a constant first height (H1).

In some embodiments, frame 34 can include one or more cross members 52 (FIG. 5). For example, frame 34 can include one or more cross members 52 connecting first transverse legs 38. Cross members 52 are configured to increase the structural integrity of frame 34 to, for example, reduce the twisting of the frame during use. It should be recognized that cross members 52 are shown by example only between first transverse legs 38. Of course, it is contemplated by the present disclosure for frame 34 to include one or more cross members 52 between first upright legs 40, second transverse legs 42, second upright legs 44, and any combinations thereof.

In some embodiments, frame 34 includes one or more cross members 52 in the region of the frame below shoulders 48, which has been determined by the present disclosure as being effective to increase the rigidity of frame 34 near gripping portion 36 to reduce twisting and increases the retention and/or makes it easier to retain the frame in the gripping portion.

Cross members 52 can be wire members such as the remaining structure of frame 34. In other embodiments, cross members 52 can simply be a tack weld (not shown) connecting adjacent portions of frame 34 before and/or after the portion enters gripping portion 36. Frame 34 and cross member 52 can have any desired cross section such as, but not limited to, circular, rectangular, polygonal, ovoid, and any combinations thereof It has been determined by the present disclosure that the force required to place the fan blade (F), or any other object to be cleaned, in opening 16 is important when using such an open ended cleaning implement 10. More particularly, the less force required to place implement 10 on to fan blade (F) makes the fan easier to clean especially due to the fact that the ceiling fan is free spinning when you are trying to clean the blade.

During assembly, a user places the open end 28 of cleaning cloth 12 over terminating end 46 of first transverse leg 38. Then, the user slides the cleaning cloth 12 over frame 34 until the open end 28 is proximate second upright leg 44.

In some embodiments, second upright leg 44 defines a shoulder 48. Shoulder 48 is configured so that when cleaning cloth 12 is properly positioned on frame 34, the elastic closure 30 is between shoulder 48 and gripping portion 36. In this manner, elastic closure 30, due to the interference with shoulder 48, maintains cleaning cloth 12 on frame 34. Of course, it is contemplated by the present disclosure for cleaning cloth 12 to be connected to frame 34 in any desired manner such as, but not limited to, a hook and loop fastening device, a zipper, buttons, snaps, twist tie, elastic, and any combinations thereof.

Frame 34 has an outer surface which is preferably of sufficient smoothness to allow cleaning cloth 12 to be slid over the frame. In addition, frame 34 can be formed of any material having sufficient strength for cleaning the fan blade. Thus, frame 34 can be made of any desired material such as, but not limited to, metal, plastic, wood, and any combinations thereof. In one embodiment, gripping portion 36 and frame 34 can be unitary members formed molded plastic.

In the illustrated embodiment, frame 34 is preferably formed of a single bent length of metal wire such that each leg of the frame includes two portions. As shown in FIGS. 5 and 6, frame 34 includes two first transverse legs 38, two first upright legs 40, two second transverse legs 42, and two second upright legs 44. Here, each of second upright legs 44 define shoulders 48.

Also seen in the illustrated embodiment, first upright leg 40 is a preferably circular bend, which defines a protruding region 50. It has also been determined by the present disclosure that protruding region 50 can, when cleaning cloth 12 is properly positioned on frame 34, assist in maintaining the cleaning cloth on the frame.

Accordingly, cleaning implement 10 includes fan blade receiving opening 16 that is closed on one end (e.g., closed end 20), and open on the opposite end (e.g., open end 22). Thus, cleaning implement 10 can find use with fan blades having widths ($W_F$) that are smaller than, equal to, or larger than the width of opening 16.

Referring now to FIGS. 7-14, a cleaning implement according to a second exemplary embodiment of the present disclosure is shown having reference numeral 110. Cleaning implement 110 includes a pair of cleaning cloths 112 and a handle 114 defining a fan blade receiving opening 116 therein. In this embodiment, opening 116 is closed at both ends 120 but is configured so that the width of opening 116 can be adjusted to fit a range of fan blade widths. More specifically, handle 114 includes a pair of frames 122, 124 each of which has an open end and a close end, where the pair of handles are oppositely disposed so that the opening 116 is closed at both ends 120.

Figure 7:
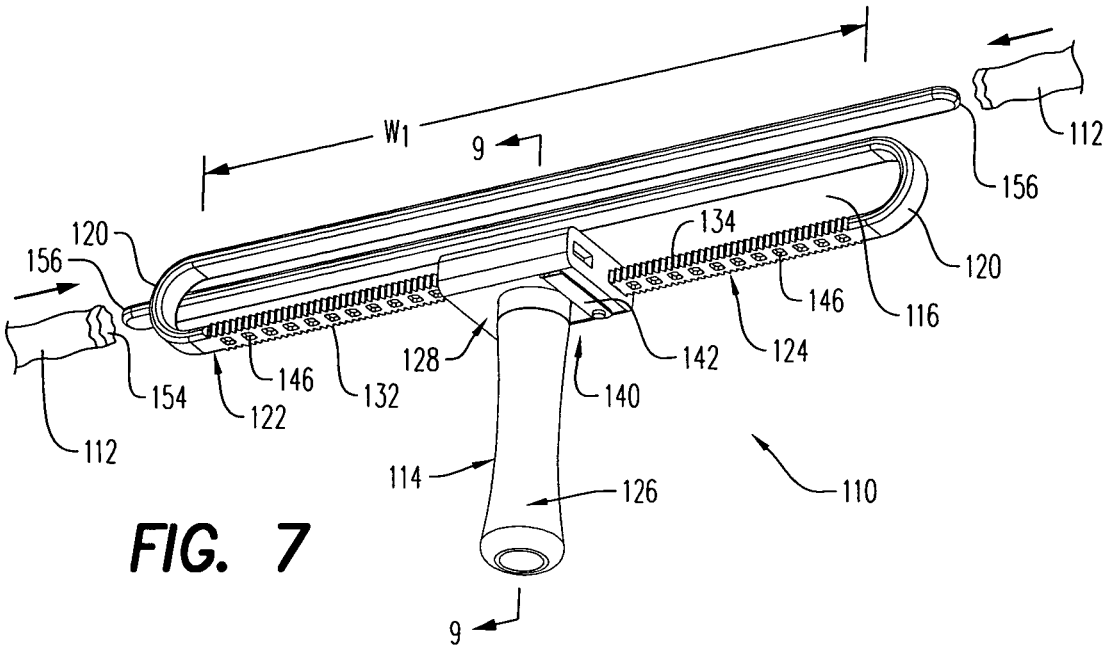
FIG. 7 is a bottom perspective view of a third exemplary embodiment of a cleaning implement according to the present disclosure, shown in a first position and having cleaning cloths removed therefrom.
Figure 9:
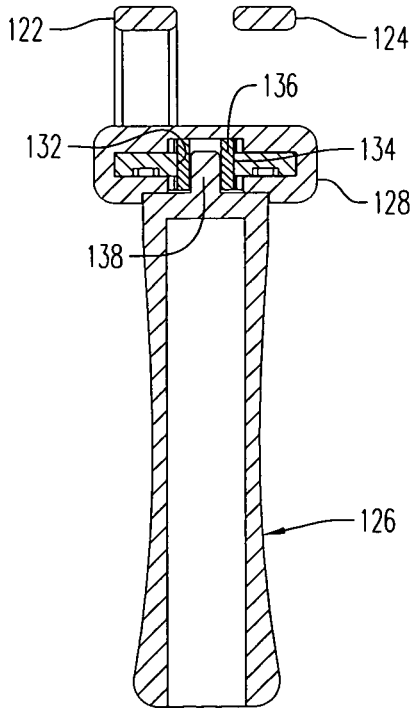
FIG. 9 is a sectional view of the cleaning implement taken along lines 9-9 of FIG. 7.
Figure 8:
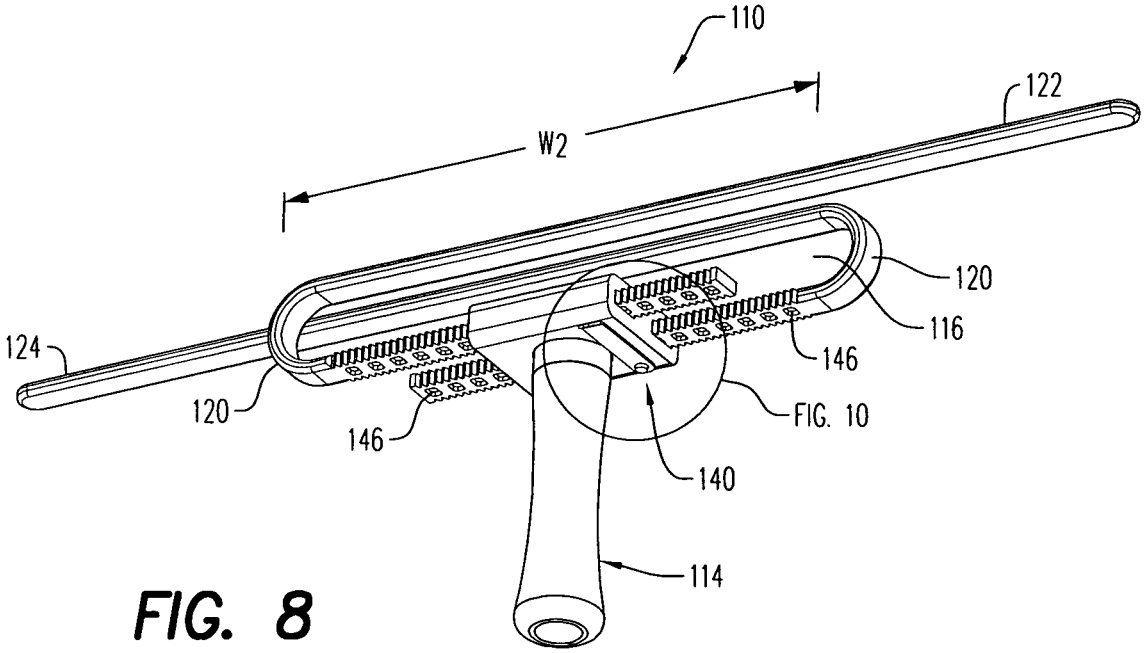
FIG. 8 is a bottom perspective view of the cleaning implement of FIG. 7, shown in a second position.
Figure 10:
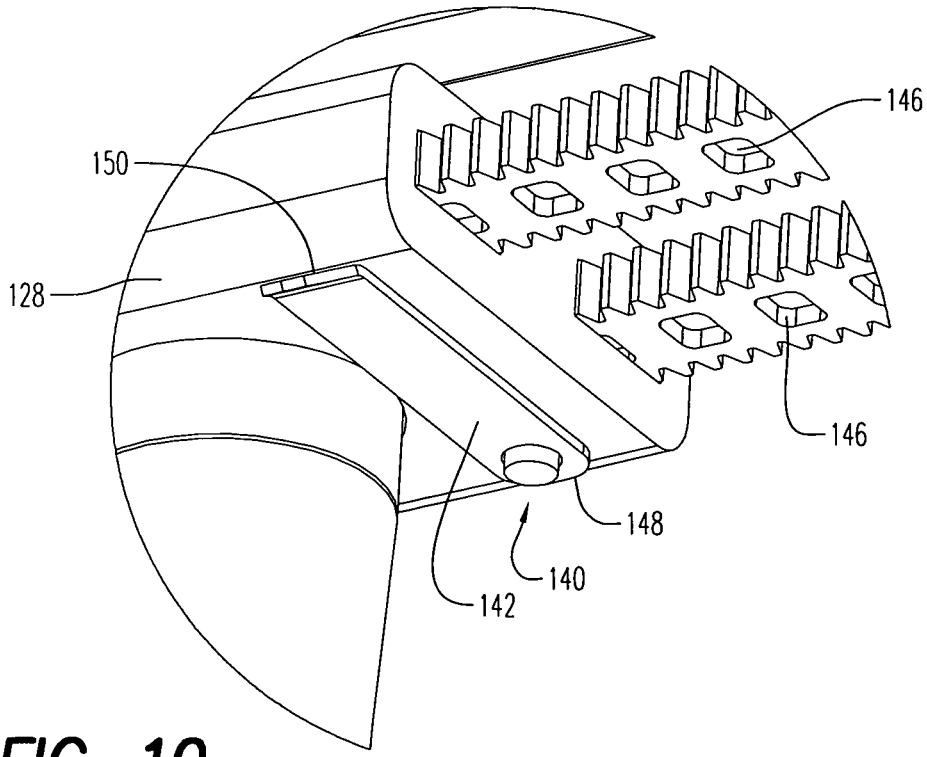
FIG. 10 is an enlarged view of a locking device of FIG. 8 shown in a locked state.
Figure 11:
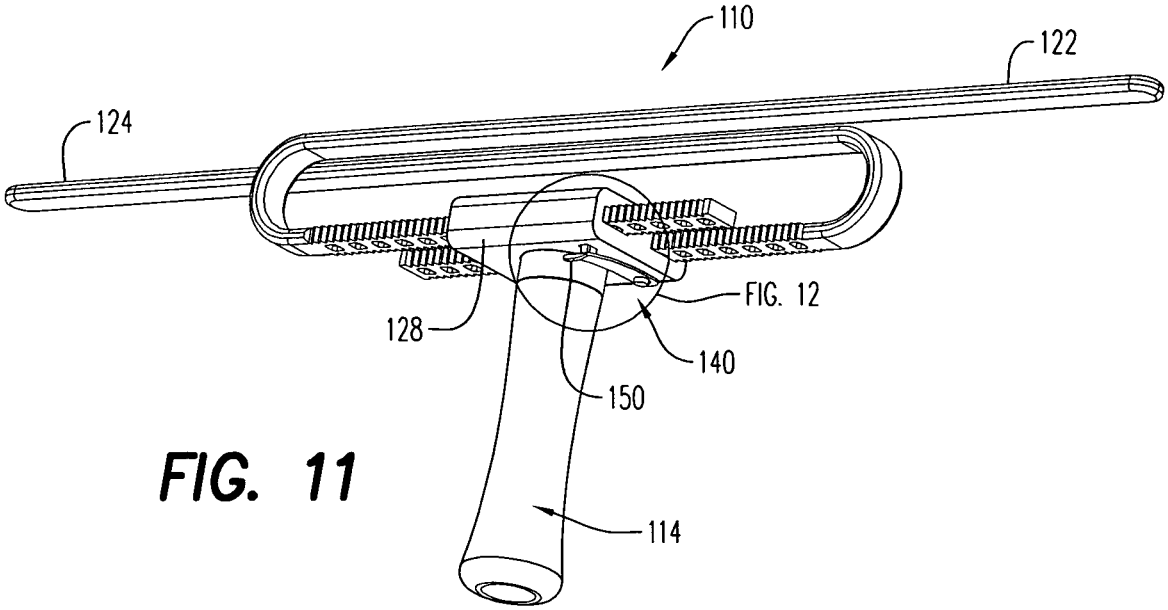
FIG. 11 is a bottom perspective view of the cleaning implement of FIG. 8 having the locking device in an unlocked state.

Cleaning implement 110 is configured for movement between a first position (FIG. 7) and a second position (FIG. 8). The first position provides opening 116 with a first width (W1), while the second position provides opening 116 with a second width (W2). Here, the first width (W1) is larger than the second width (W2). In this manner, the cleaning implement 110 can be adapted for use with fan blades of varying widths such that the blade (F) can be cleaned in one pass.

Handle 114 includes a first frame 122, a second frame 124, a gripping portion 126, and a cover 128. In some embodiments of handle 114, gripping portion 126 and frame 122, 124 can be separate molded members such as shown in FIG. 7.

In the illustrated embodiment, first frame 122 includes a first geared edge 132, while second frame 124 includes a second geared edge 134. First and second geared edges 132, 134 are operatively engaged with one another by a gear 136. Gear 136 is rotatably supported on a stud 138 depending from gripping portion 126. Cover 128 is disposed over gear 136, stud 138, and the portions of the first and second geared edges 132, 134 that are engaged with the gear. In this manner, forces applied to move either the first frame 122 or the second frame 122 are transmitted via interaction of gear 136 and geared edges 132, 134 to result in movement of both of the frames a corresponding amount. Of course, it is contemplated by the present disclosure for gear 136 to have any other location on cleaning implement 110 sufficient to operative engage frames 122 and 124.

In order to maintain cleaning implement 110 in a desired position having opening 116 of a desired width, handle 114 further includes a locking device 140. Locking device 140 includes a locking member 142 having a locking protrusion 144. First and second frames 122, 124 each include a plurality of locking holes 146. Locking holes 146 are sized to removably receive locking protrusions 144.

Locking member 142 includes a first end 148 secured to cover 128. Locking member 142 is normally biased to a locked state (FIG. 10) having locking protrusions 144 received in locking holes 146. In this position, locking device 140 prevents movement of first and second frame 122, 124.

Locking member 142 is elastically deformable to an unlocked state (FIG. 12) having locking protrusions 144 removed from locking holes 146. In this position, locking device 140 allows movement of first and second frames 122, 124 between the first and second positions.

Figure 12:
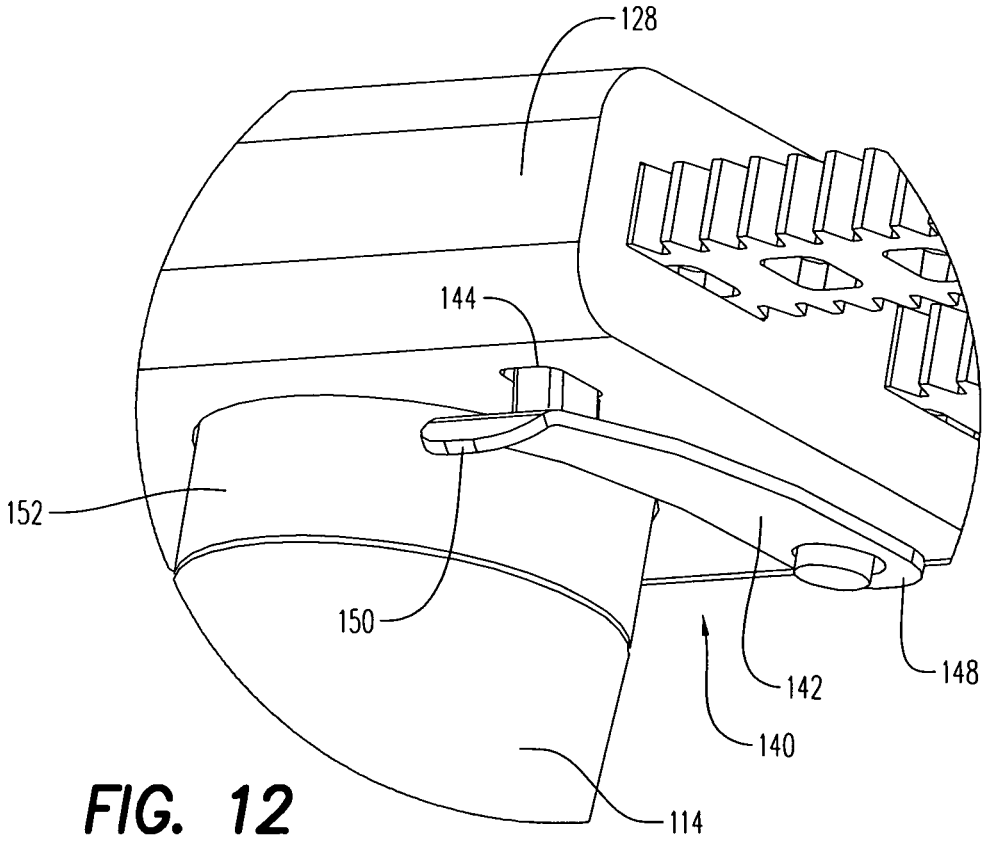
FIG. 12 is an enlarged view of the locking device of FIG. 11.
Figure 13:
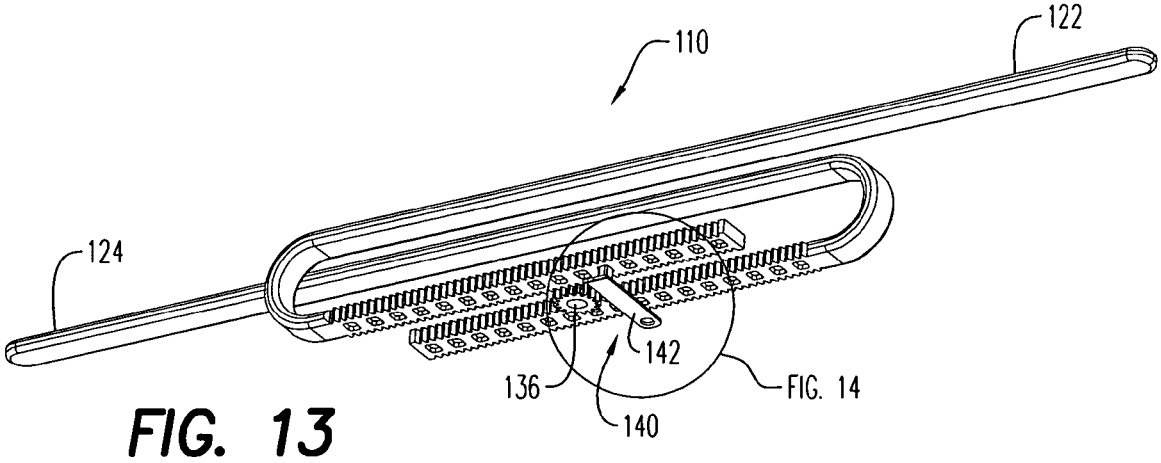
FIG. 13 is a bottom perspective view of the cleaning implement of FIG. 7 having various elements removed for clarity and having the locking device in a partially locked state.
Figure 14:
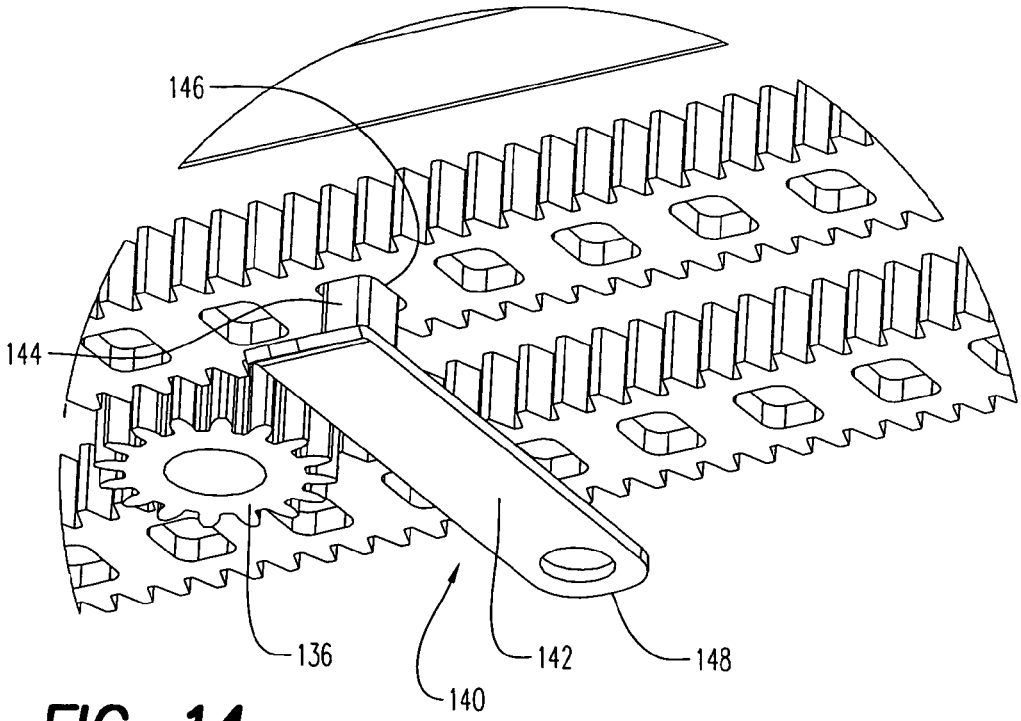
FIG. 14 is an enlarged view of the locking device of FIG. 13
Figure 15:
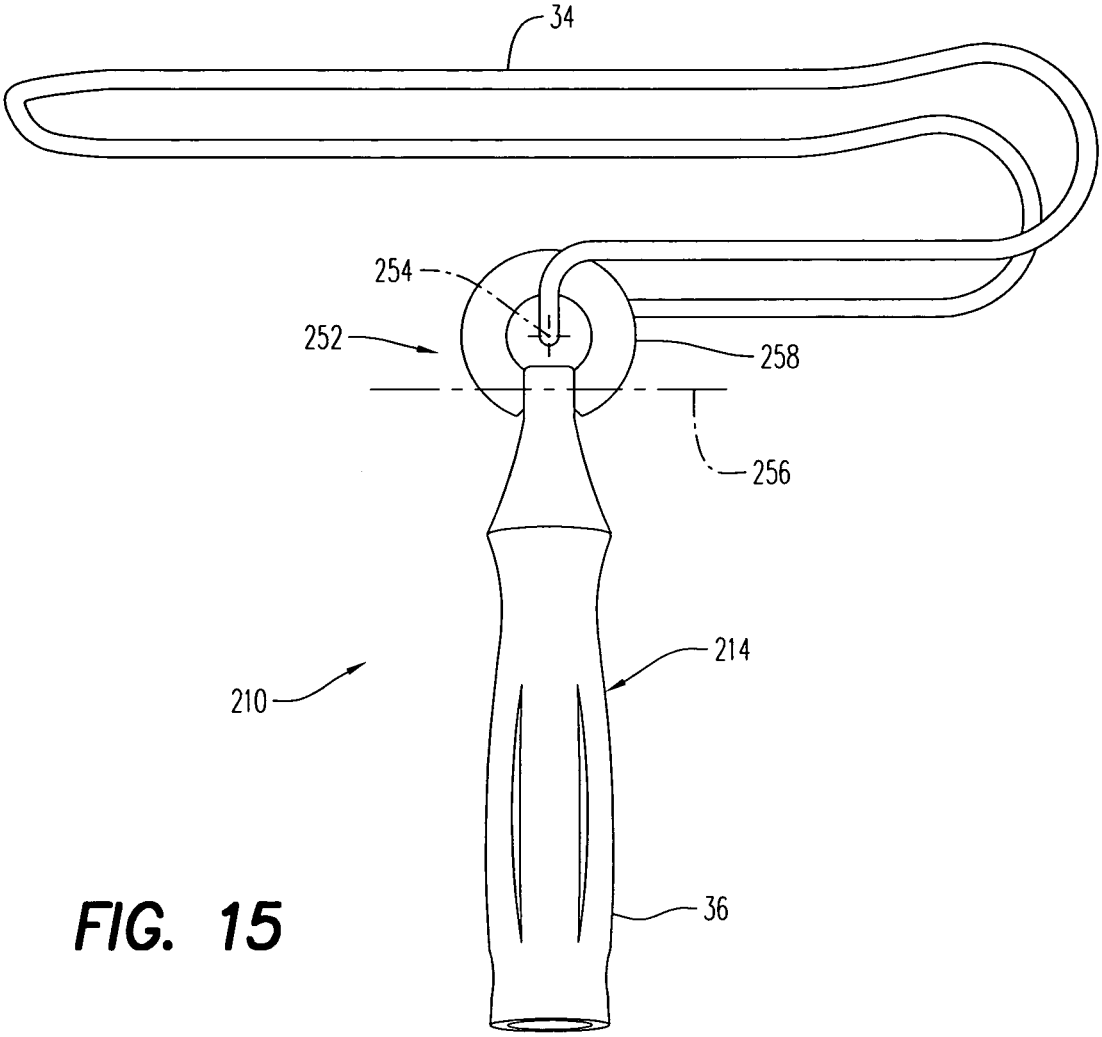
FIG. 15 is a side perspective view of a fourth exemplary embodiment of a cleaning implement according to the present disclosure.
Figure 16:
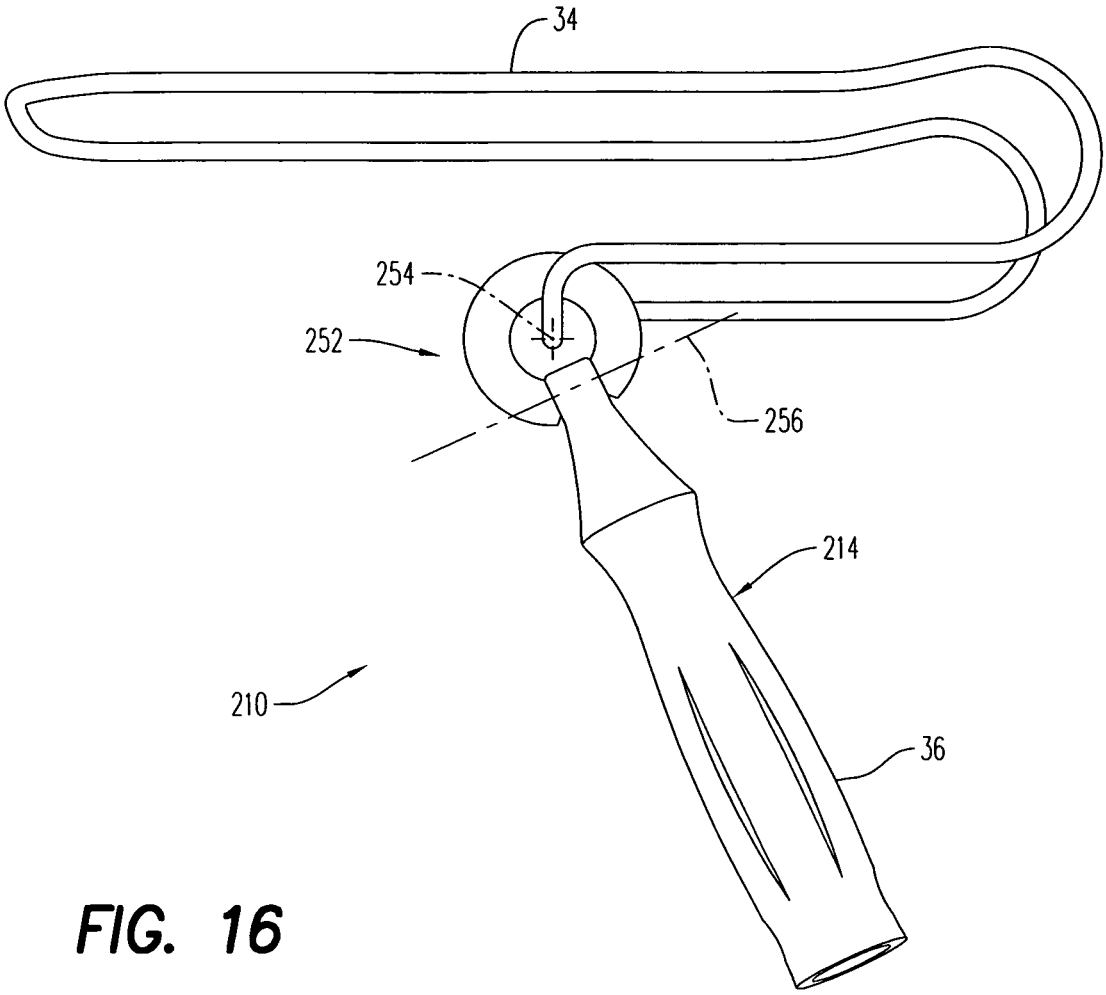
FIG. 16 is a side perspective view of the cleaning implement of FIG. 15 rotated in a first direction about a first axis.
Figure 17:
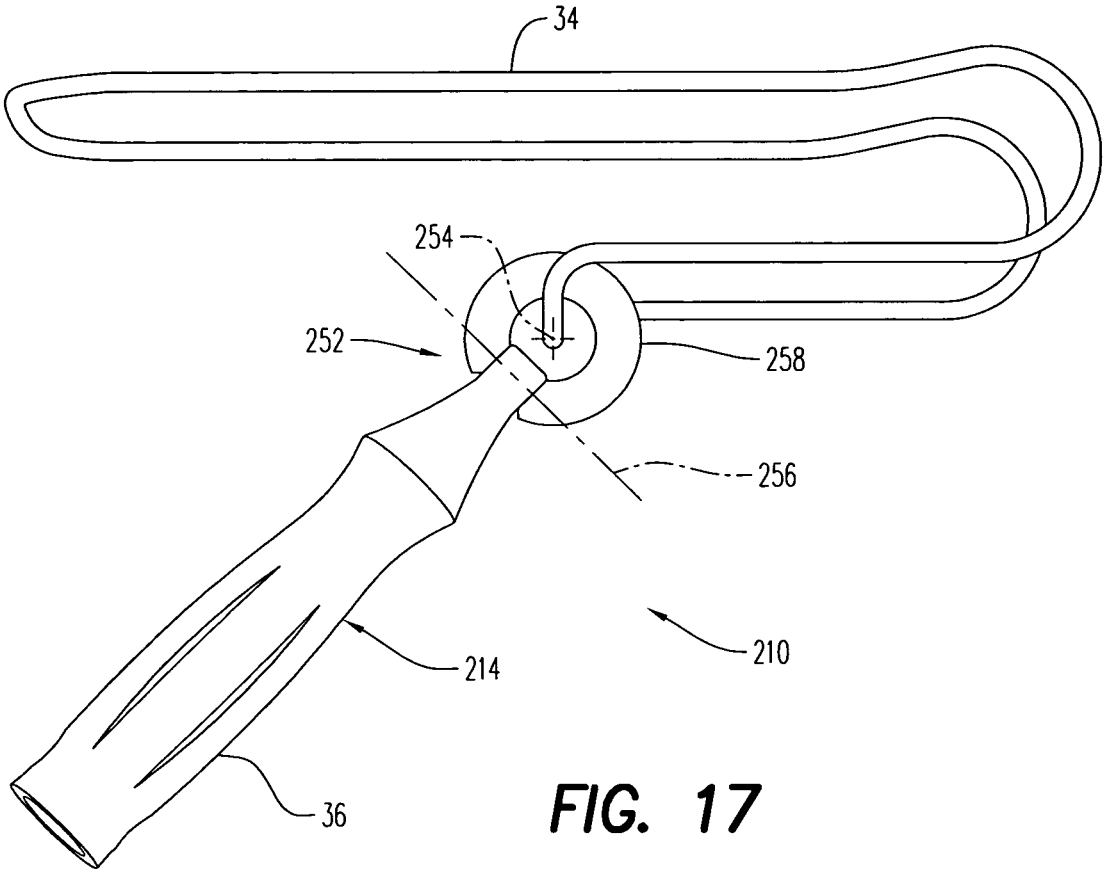
FIG. 17 is a side perspective view of the cleaning implement of FIG. 15 rotated in a second direction about the first axis.
Figure 18:
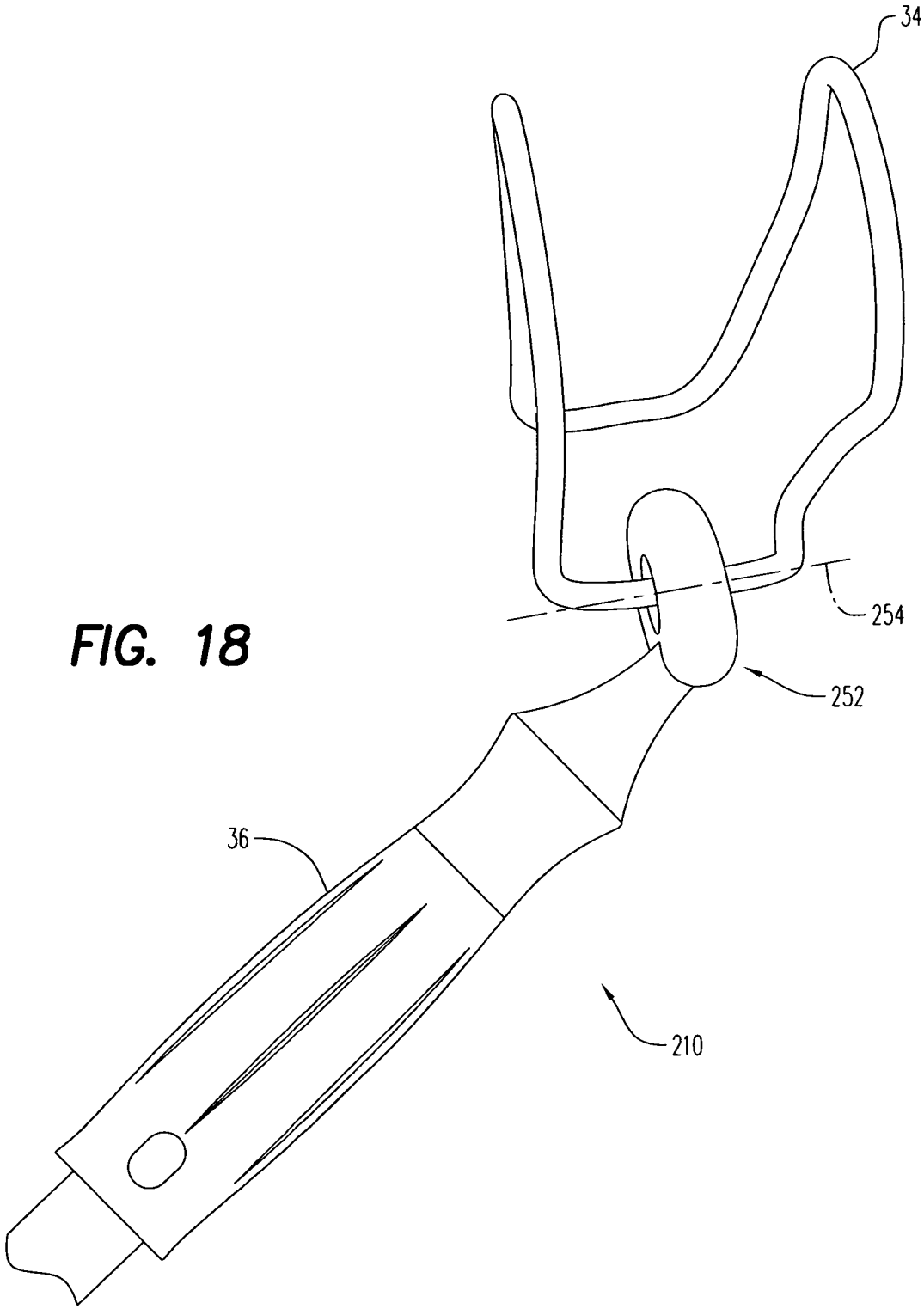
FIG. 18 is a back view of the cleaning implement of FIG. 15 rotated in a first direction about a second axis.

Locking member 142 can include a finger lever 150 defined thereon to allow a user to apply pressure to the locking member to elastically deform the locking member from the locked state (FIG. 10) to the unlocked state (FIG. 12). Upon release of pressure from locking member 142, the locking member returns to the locked state under its own resiliency.

Of course, it should be recognized that locking member 142 is described by way of example engaging with frame 122. For example, it is contemplated by the present disclosure for locking member 142 to lock gear 136. Here, locking protrusion 144 can be configured to fit within the tooth spacing of gear 136 so that when the locking member 142 is in the normally locked state, the locking protrusion prevents rotation of the gear to maintain frames 122, 124 in the desired position.

In some embodiments, handle 114 can further include a pivot member 152 between gripping portion 126 and stud 138. Pivot member 152 is configured to allow gripping portion 126 to be angled with respect to stud 138, and thus with respect to frames 122, 124.

During assembly, a user places an open end 154 of cleaning cloth 112 over a terminating end 156 of each of the first and second frames 122, 124. Then, the user slides the cleaning cloths 112 over frames 122, 124 until the open end 154 is proximate geared edges 132, 134.

In some embodiments, frames 122, 124 can define a shoulder (not shown) at geared edges 132, 134. The shoulder can be configured so that when cleaning cloths 112 are properly positioned on frames 122, 124, an elastic closure (not shown but similar to elastic closure 30 of FIG. 2B) of the cleaning cloths are secured over the shoulder. In this manner, the shoulder and elastic end can maintain the cleaning cloths 112 on frames 122, 124. Of course, it is contemplated by the present disclosure for cleaning cloths 112 to be connected to frames 122, 124 in any desired manner such as, but not limited to, a hook and loop fastening device, buttons, snaps, twist tie, and any combinations thereof.

Frames 122, 124 have an outer surface of sufficient smoothness to allow cleaning cloths 112 to be slid over the frames. In addition, frame 122, 124 can be formed of any material having sufficient strength for cleaning the fan blade. Thus, frames 122, 124 can be made of any desired material such as, but not limited to, metal, plastic, wood, elastomeric, rubber, thermoplastic elastomer (TPE), and any combinations thereof. In the illustrated embodiment, frames 122, 124 are identically molded plastic parts.

Referring now to FIGS. 15-18, another alternate embodiment of a cleaning implement according to the present disclosure is shown and is generally referred to by reference numeral 210 includes a handle 214.

Handle 214 includes a frame 34 and a gripping portion 36 as disclosed in detail above with respect to FIGS. 5 and 6. Further, handle 214 is configured for use with a cleaning cloth 12 as disclosed in detail above with respect to FIGS. 1-4.

In addition, handle 214 includes a rotation device 252 connecting frame 34 and gripping portion 36. Advantageously, rotation device 252 secures gripping portion 36 and frame 34 to one another such that the gripping portion and frame can be selectively moved into a variety of angled positions with respect to one another around one axis, or in other embodiments around two axes.

By way of example, rotation device 252 can be as shown and described in Applicant's own U.S. patent application Ser. No. 10/896,246, the content of which are incorporated by reference herein. For example, rotation device 252 can be a two-axis swivel joint connecting frame 34 and gripping portion 36 that allows the frame and gripping portion to swivel with respect to one another about a first axis 254 and a second axis 256.

Rotation device 252 swivels in a side-to-side direction about first axis 254 and in a back-and-forth direction about second axis 256. First axis 254 is offset with respect to second axis 256 such that the two axes do not intersect with one another.

Rotation device 252 has a pivot member 258. Frame 34 is secured to pivot member 258 so that the frame rotates about the first axis 254. Gripping portion 36 is secured to pivot member 258 so that the gripping portion rotates about the second axis 256.

In some embodiments, rotation device 252 is configured to selectively maintain frame 34 and gripping portion 36 at a selected angle. For example, rotation device 252 can include a plurality of detents (not shown) for each axis 254, 256 that allows the desired angular positions to be maintained. In other embodiments, rotation device 252 can include a spring loaded lever for each axis 254, 256 to selectively release and lock of the rotation device in the desired angular positions. In still another embodiment, rotation device 252 can have a split hub allowing the user to selectively tighten the joint via a knob which reduces the inner diameter causing a substantial increase of friction within the joint. This friction allows the selected position to remain fixed during usage. One skilled in the art can appreciate that other methods are possible to keep the joints from rotating relative to each other.

Accordingly, it is contemplated by the present disclosure for rotation device 252 to be a one-axis swivel joint or a two-axis swivel joint connecting frame 34 and gripping portion 36 to one another. Further, it is contemplated by the present disclosure for the rotation device 252 to be selectively lockable about one or, when present, both axes.

Figure 19:
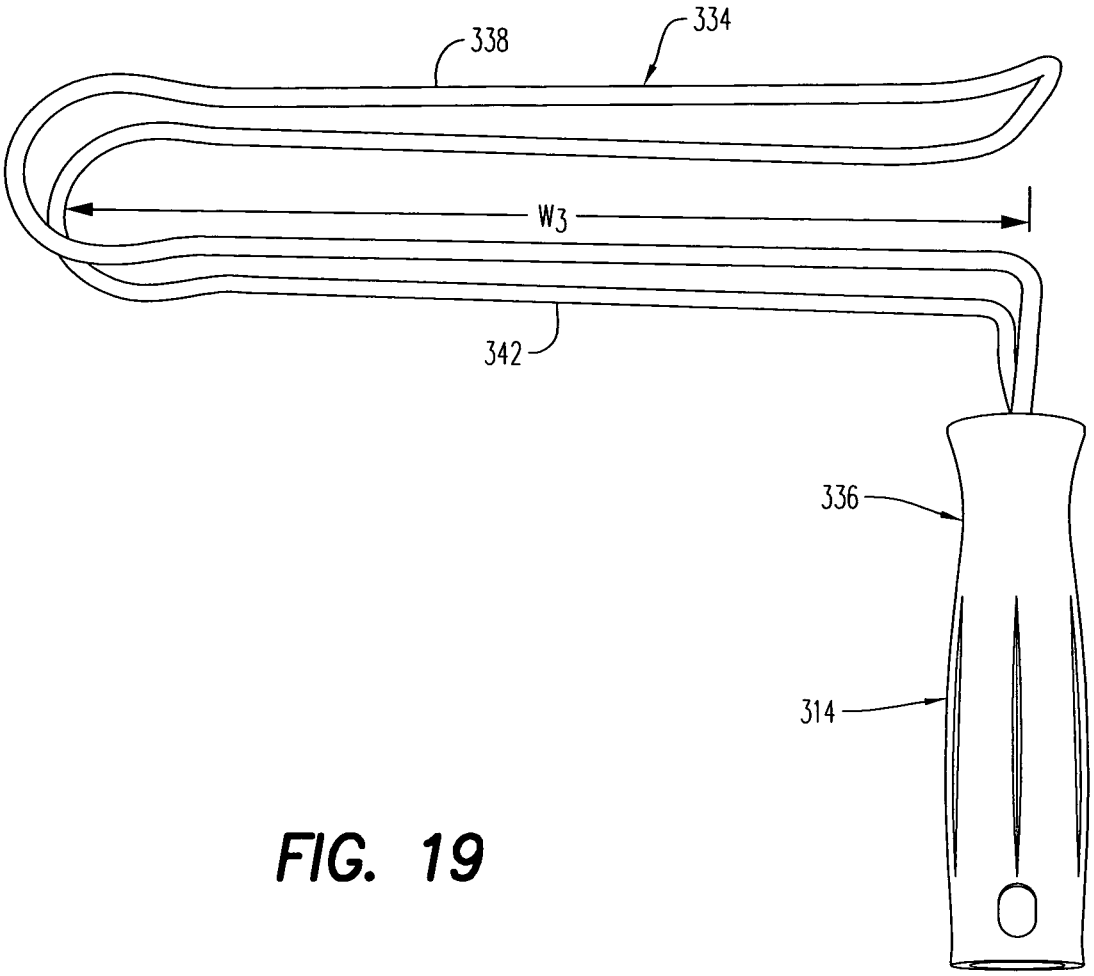
FIG. 19 is a side perspective view of another exemplary embodiment of a cleaning implement according to the present disclosure having a cleaning cloth removed.
Figure 20:
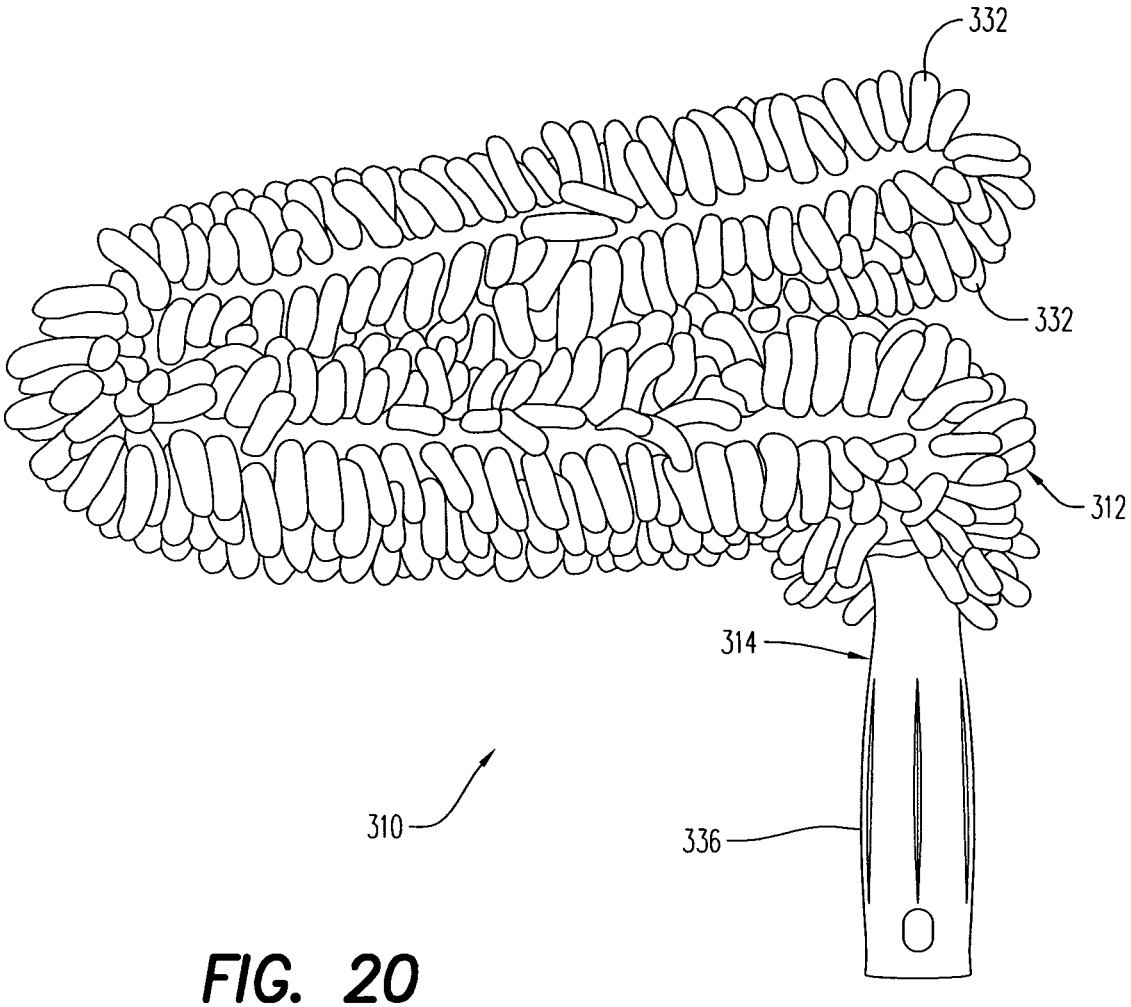
FIG. 20 is a side perspective view of the cleaning implement of FIG. 19 having the cleaning cloth installed.

Referring now to FIGS. 19 and 20 another exemplary embodiment of a cleaning implement according to the present disclosure is shown and is generally referred to by reference numeral 310.

Cleaning implement 310 includes a handle 314 having a frame 334 and a gripping portion 336. Further, handle 314 is configured for use with a cleaning cloth 312.

It should be recognized that cleaning implement 310 is illustrated by way of example in use with cleaning cloth 312 that is shown as a microfiber cleaning cloth having a twisted loop pile 332 on two sides. Of course, it is contemplated by the present disclosure for cleaning implement 310 to find use with any cleaning cloth 312 such as, but not limited to cleaning cloths having twisted loop pile 332 on only one side or any other cleaning cloth capable of a cleaning action such as removing dust.

Further, cleaning cloth 312 can include any type cleaning surface such as, but not limited to, an abrasive surface, a wettable surface, a natural fiber surface, a cotton surface, a microfiber surface, materials having electrostatic properties, and any combinations thereof. It is also contemplated by the present disclosure for cleaning cloth 312 to be made from any desired manufacturing process such as, but not limited to, as knitting, weaving, non-woven methods, and others.

It should also be recognized that cleaning implement 310 is illustrated by way of example having frame 334 secured to gripping portion 336. Of course, it is contemplated by the present disclosure for cleaning implement 310 to include a frame and gripping portion that are secured to one another such that the gripping portion and frame can be selectively moved into a variety of angled positions with respect to one another as discussed in detail above with respect to the embodiment of FIGS. 15-18.

Frame 334 and gripping portion 336 are substantially identical to the embodiment described above with respect to FIGS. 5 and 6. However in this embodiment, frame 334 has a first transverse leg 338 and a second transverse leg 342 that are substantially equal in width (W3).

Figure 21:
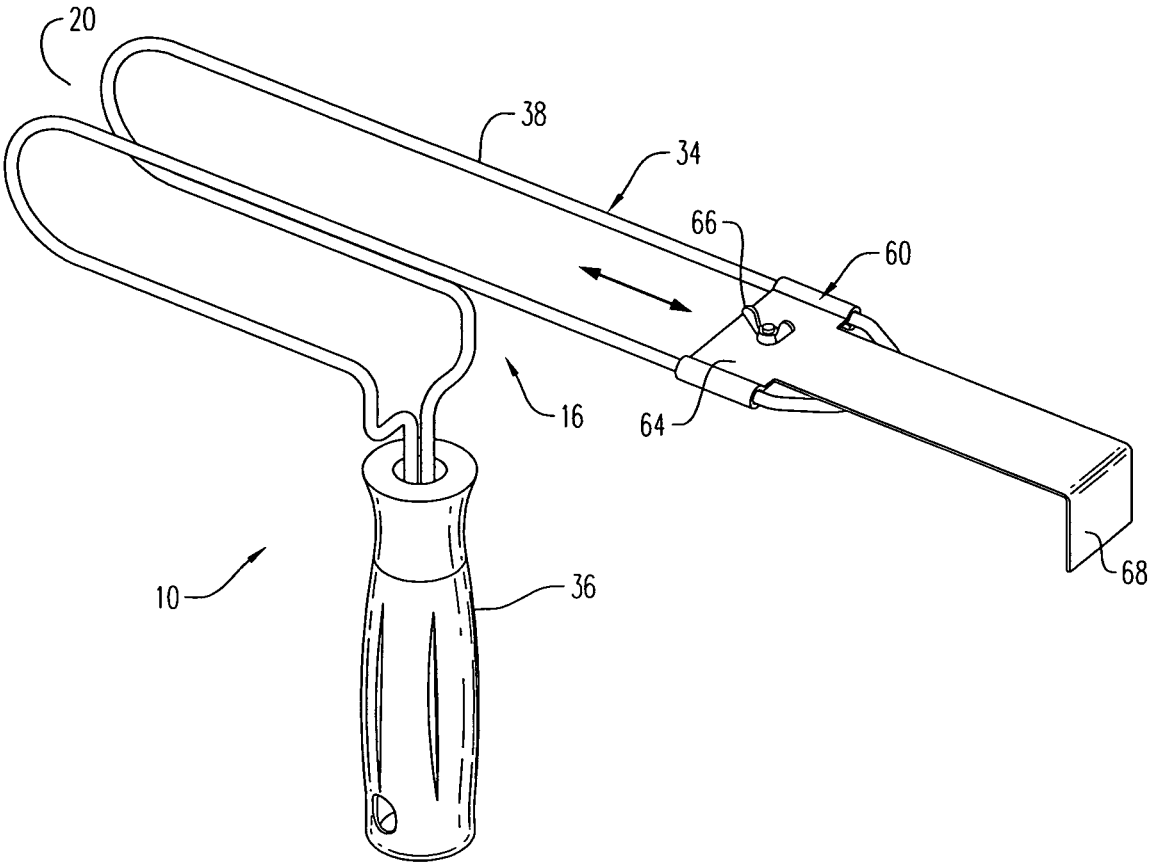
FIG. 21 is a top perspective view of the cleaning implement of FIG. 1 having a first exemplary embodiment of an extension device shown with the cleaning cloth removed.
Figure 22:
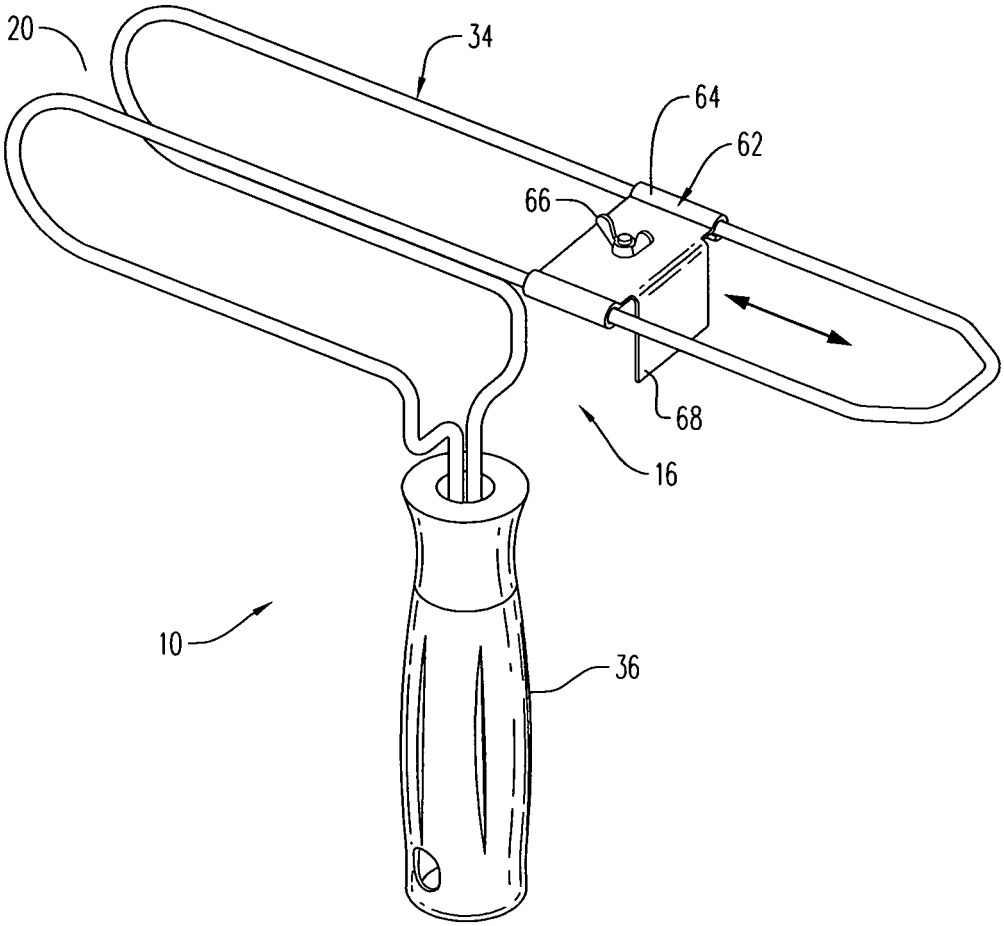
FIG. 22 is a top perspective view of the cleaning implement of FIG. 1 having a second exemplary embodiment of an extension device shown with the cleaning cloth removed.
Figure 24:
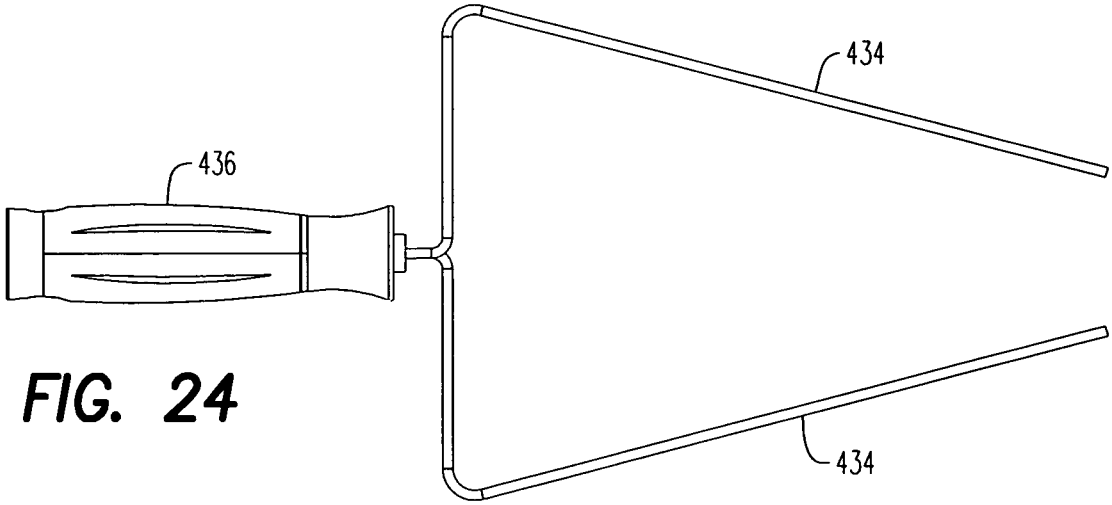
FIGS. 23 through 28 illustrate another exemplary embodiment of a cleaning implement according to the present disclosure.
Figure 23:
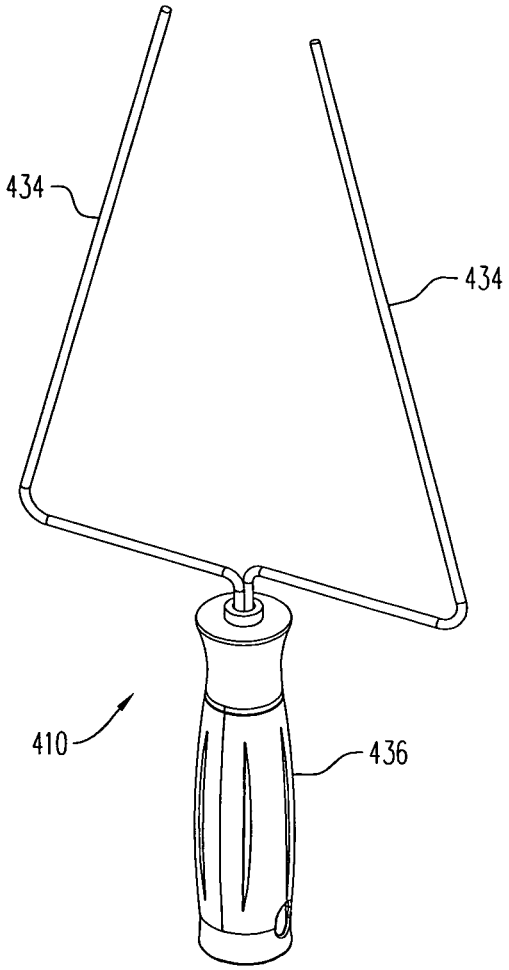
Figure 25:
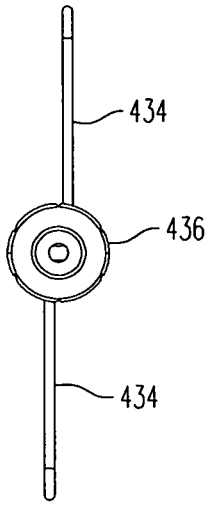

Referring now to FIGS. 21 and 22, exemplary embodiments of extension devices according to the present disclosure for use with cleaning implement 10 are shown and are generally referred to by reference numerals 60 and 62, respectively. Advantageously, extension devices 60, 62 allow the user to selectively adjust the width of opening 16 as needed to fit various size fan blades.

It has been determined by the present disclosure that extension device can acts as a guide to make it easier to put implement 10 on fan blade (F) without the fan blade rotating away from the duster because the fan blade is free spinning and will rotate as the duster is put onto the fan blade Extension devices 60, 62 each preferably include a top plate 64, a bottom plate (not shown), a connecting device 66, and a downwardly depending leg 68. Downwardly depending leg 68 allows the cleaning implement 10 to clean the side edge of the fan blade, while closed end 20 cleans the opposite side edge of the fan blade. In addition, downwardly depending leg 68 can help to keep the fan blade from rotating during use of cleaning implement 10.

Connecting device 66 is configured to be tightened to compress first transverse leg 38 of frame 34 between the top and bottom plates. Connecting device 66 is further configured to be loosened to allow the extension devices 60,62 to be moved along the length of first transverse leg 38. When screw 66 is loosened to a predetermined point, extension devices 60,62 can be removed from first transverse leg 38. Of course, it is contemplated by the present disclosure for connecting device 66 to include any connecting device configured to selectively secure downwardly depending leg 68 in a desired position on first transverse leg 38 of frame 34.

Extension device 60 is configured to adjust the width of opening 16 to less than the length of first transverse leg 38, while extension device 62 is configured to adjust the width of opening 16 to greater than the length of first transverse leg 38.

It should be recognized that extension devices 60, 62 are illustrated by way of example in use with cleaning implement 10. Of course, it is contemplated by the present disclosure for extension devices 60, 62 to find equal use with cleaning implement 310 described herein.

Extension devices 60, 62 can be placed directly on first transverse leg 38 as shown, with the cleaning cloth placed over the extension device. In some embodiments, the cleaning cloth can include a plurality of spaced openings (not shown) to receive downwardly depending leg 68 therein. In other embodiments, extension devices 60 and 62 can be place onto cleaning cloth 12 after the cleaning cloth has been assembled onto cleaning implement 10.

Advantageously, extension device 60 allows opening 16 of frame 34 to be adjusted to different widths. In embodiments having extension device 60 and where cleaning cloth 12 is placed over frame 34 and the extension device, cleaning implement 10 is configured to use both the frame and the extension device to place the cleaning cloth to contact the surface of the object to be cleaned. In this manner, extension device 60 can be used as a guide to get the fan blade (F) into opening 16 and to clean all sides of the blade and/or three sides of the blade at once.

Referring now to FIGS. 23 through 28, another exemplary embodiment of a cleaning implement according to the present disclosure is shown and is generally referred to by reference numeral 410. Cleaning implement 410 includes a pair of adjustable frames 434 secured in a gripping portion 436.

Figure 26:
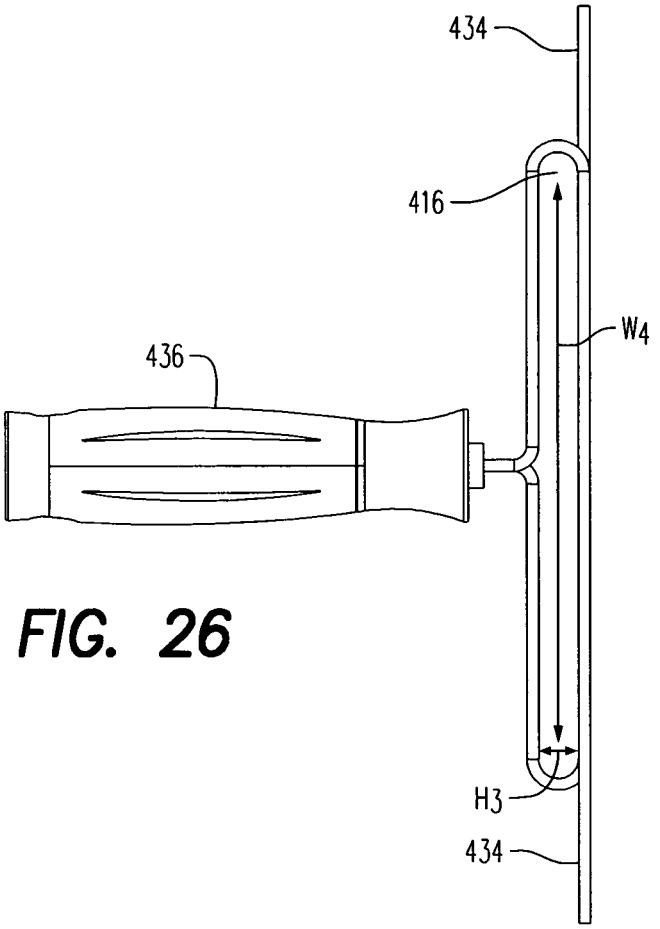
Figure 28:
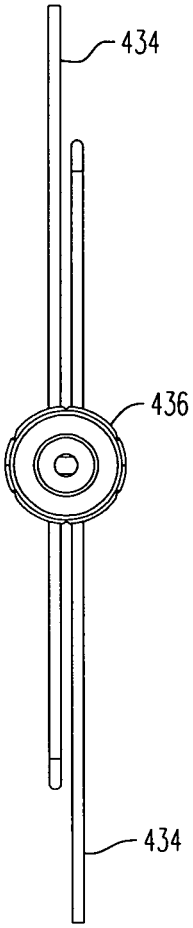
Figure 27:
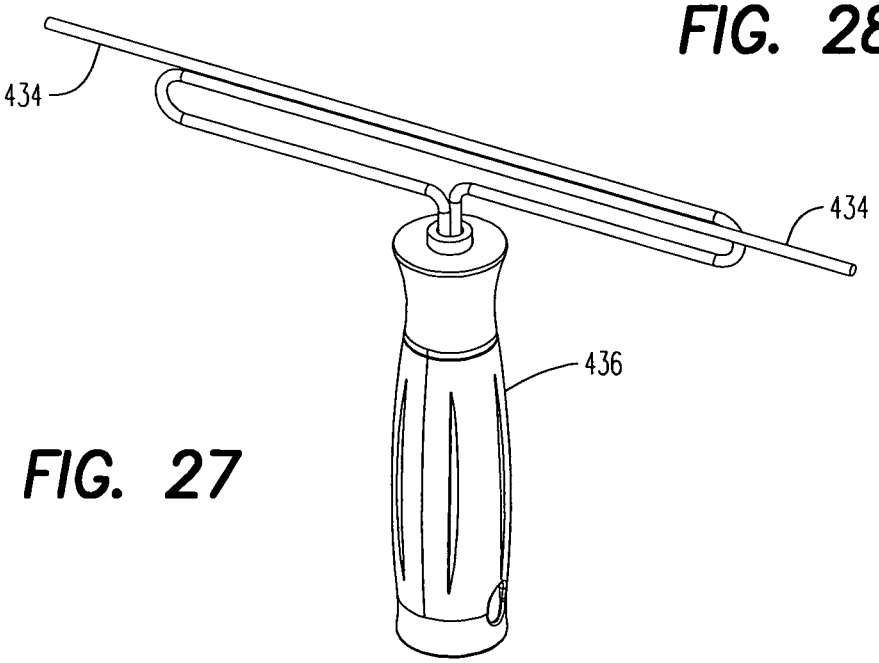
Figure 29:
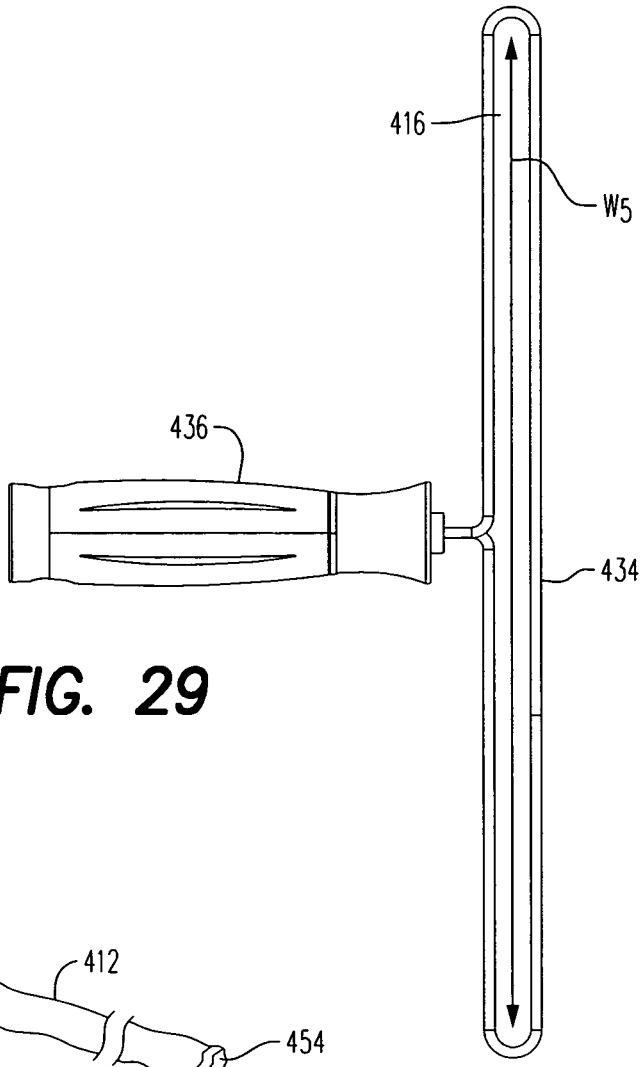
FIGS. 29 through 31 illustrate another exemplary embodiment of a cleaning implement according to the present disclosure.
Figure 31:
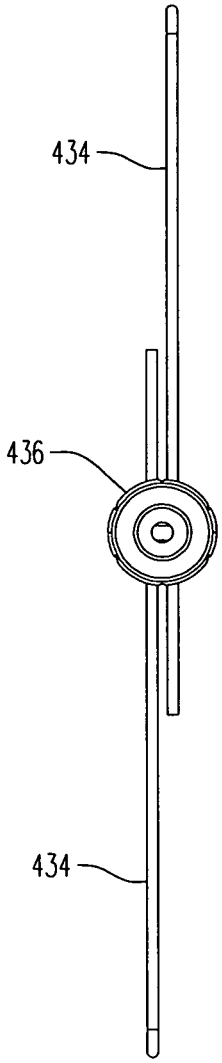
Figure 30:
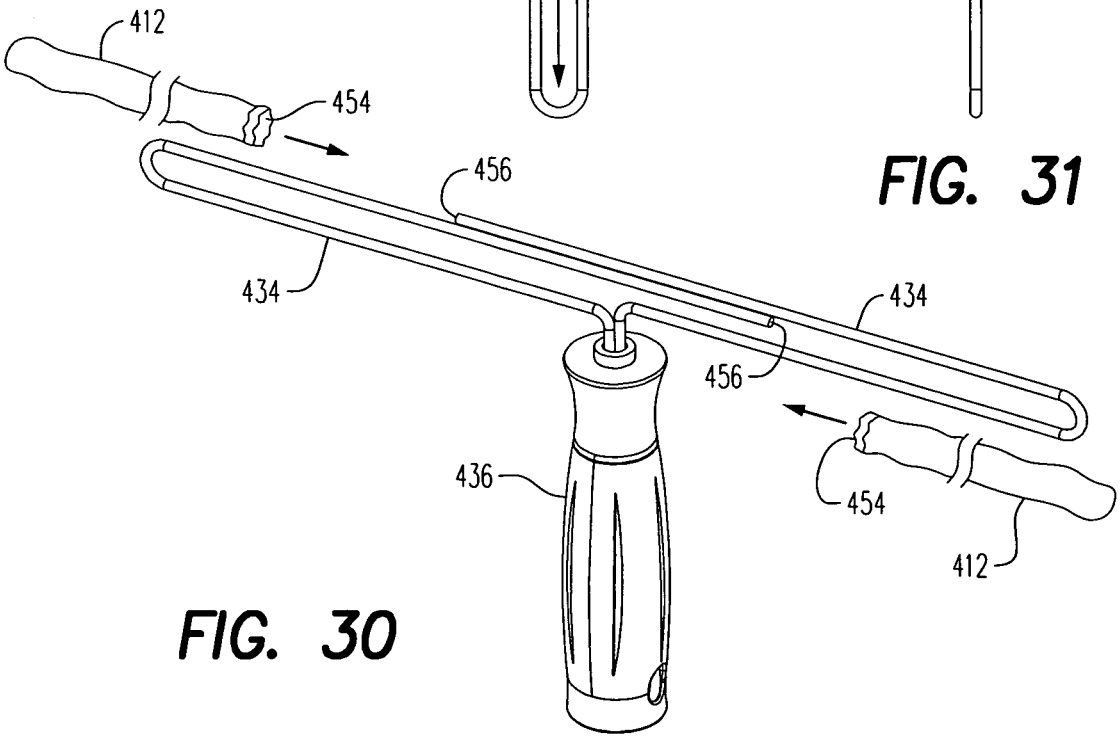

In one embodiment, frames 434 are formed of a bendable material so that the frames can be adjusted to provide opening 416 with either a first width (W5) as in FIGS. 29-31 or a second width (W4) as in FIGS. 26-28 and/or can be adjusted to provide opening 416 with an adjustable height (H3). It is contemplated by the present disclosure for the bendable material to be any material having sufficient rigidity to support cloth 412 during cleaning, but flexible enough to allow the user to bend the frames to the desired shape. For example, frames 434 can be formed of steel, aluminum, low carbon steel, stainless steel, polymers, and any combinations and/or alloys thereof.

In another embodiment, frames 434 can include a plurality of moveable hinges (not shown) that allow the frames to be adjusted to provide opening 416 with either a first width (W5) as in FIGS. 29-31 or a second width (W4) as in FIGS. 26-28 and/or can be adjusted to provide opening 416 with an adjustable height (H3).

As seen in FIG. 30, cleaning implement 410 includes a pair of cleaning cloths 412, namely one for each frame 434. During assembly, a user places an open end 454 of cleaning cloth 412 over a terminating end 456 of each of the frames 434. Then, the user slides the cleaning cloths 412 over frames 434 until the open end 454 is proximate gripping portion 436.

Of course, it is contemplated by the present disclosure for cleaning cloths 412 to be connected to frames 434 in any desired manner such as, but not limited to, a hook and loop fastening device, a zipper, buttons, snaps, twist tie, and any combinations thereof.

It should also be recognized that cleaning implement 410 is illustrated by way of example having frames 434 fixedly secured to gripping portion 436. Of course, it is contemplated by the present disclosure for cleaning implement 410 to include frames and a gripping portion that are secured to one another such that the gripping portion and frames can be selectively moved and, in some embodiments locked, into a variety of angled positions with respect to one another as discussed in detail above with respect to the embodiment of FIGS. 15-18.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. In addition combinations of the different features can be combined to create different products. Therefore, it is intended that the present disclosure not be limited to the particular embodiment(s) disclosed as the best mode contemplated, but that the disclosure will include all embodiments falling within the scope of the present disclosure.

What is claimed is:

1. A cleaning implement for cleaning a ceiling fan blade, comprising:

a gripping portion;

a frame connected to the gripping portion; and a single cleaning cloth, wherein said frame consists of a first transverse leg, a second transverse leg, and a first upright leg separating said first transverse leg from said second transverse leg to define an elongated blade receiving opening having a major axis and a minor axis therebetween, said first upright leg depending from said first transverse leg in a direction substantially parallel to and away from said gripping portion, and said first upright leg and closing said elongated blade receiving opening along said minor axis at only one end with said opposite end along said minor axis remaining open, said single cleaning cloth removably disposed on said frame so that a cleaning surface of said single cleaning cloth simultaneously contacts three surfaces of the ceiling fan blade when the ceiling fan blade is received in said elongated blade receiving opening.

2. The cleaning implement of claim 1, wherein said frame is formed of a bendable material so that a height of said elongated blade receiving opening can be adjusted.

3. The cleaning implement of claim 1, wherein said frame is formed of a bendable material so that a width of said elongated blade receiving opening can be adjusted.

4. The cleaning implement of claim 3, wherein said height of said elongated blade receiving opening can be adjusted.

5. The cleaning implement of claim 1, wherein said gripping portion is secured to said frame such that said gripping portion and said frame can be selectively moved to a variety of angled positions with respect to one another.

6. The cleaning implement of claim 1, wherein said gripping portion further comprises an opening connectable to a pole.

7. The cleaning implement of claim 1, wherein said first transverse leg depends from said gripping portion.

8. A cleaning implement for cleaning a ceiling fan blade, comprising:

a cleaning cloth;

a gripping portion; and a frame consisting of a first leg depending transversely from said gripping portion, a second leg depending from said first leg in a direction substantially parallel to and away from said gripping portion, and a third leg depending transversely from said second leg so that said first and third legs are separated from one another to define an elongated blade receiving opening closed at only one end by said second leg, said first leg being shorter than said third transverse leg, said cleaning cloth being removably disposed on said frame so that a cleaning surface of said cleaning cloth simultaneously contacts three surfaces of the ceiling fan blade when the ceiling fan blade is received in said elongated blade receiving opening.

9. The cleaning implement of claim 8, wherein said frame is formed of a bendable material.

10. The cleaning implement of claim 8, wherein said cleaning cloth has a generally tubular body with a first end and a second end, wherein at least one of said first and second ends is open so that said cleaning cloth can be removably disposed on said frame.

11. The cleaning implement of claim 10, wherein at least one of said first and second ends further comprises an elastic closure.

12. The cleaning implement of claim 8, wherein said cleaning cloth comprises a microfiber cleaning cloth having a twisted loop pile.

13. The cleaning implement of claim 8, wherein said cleaning cloth comprises a cleaning surface selected from the group consisting of an abrasive surface, a wettable surface, a natural fiber surface, a cotton surface, a microfiber surface, a twisted loop microfiber surface, a electrostatic surface, and any combinations thereof.

14. The cleaning implement of claim 8, wherein said gripping portion further comprises an opening connectable to a pole.

15. The cleaning implement of claim 8, wherein said gripping portion is secured to said frame such that said gripping portion and said frame are locked into a single position with respect to one another.

16. The cleaning implement of claim 8, wherein said gripping portion is secured to said frame such that said gripping portion and said frame can be selectively moved to a variety of angled positions with respect to one another.

17. The cleaning implement of claim 8, wherein said frame further comprises a height adjusting device configured to selectively adjust a height of said elongated blade receiving opening.

18. A cleaning implement for cleaning a ceiling fan blade, comprising:

a cleaning cloth;

a gripping portion; and a frame consisting of a first leg depending transversely from a first terminal end of said gripping portion, a second leg depending upwardly from said first leg, and a third leg depending transversely from said second leg so that said first and third legs are separated from one another by said second leg to define an elongated blade receiving opening that is positioned above said first terminal end of said gripping portion, said elongated blade receiving opening having a major axis along said first and third legs and a minor axis along said second leg, wherein said second leg closes one end of said elongated blade receiving opening and an opposite end of said elongated blade receiving opening remains open to receive the ceiling fan blade.

19. The cleaning implement of claim 18, wherein said frame is formed of a bendable material.

20. The cleaning implement of claim 18, wherein said cleaning cloth has a generally tubular body with a first end and a second end, wherein at least one of said first and second ends is open so that said cleaning cloth can be removably disposed on said frame.

* * * * *